US009231306B2

(12) United States Patent
Abe

(10) Patent No.: US 9,231,306 B2
(45) Date of Patent: Jan. 5, 2016

(54) PATCH ANTENNA AND WIRELESS COMMUNICATIONS DEVICE

(71) Applicant: CASIO COMPUTER CO., LTD., Tokyo (JP)

(72) Inventor: Kazuaki Abe, Iruma (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 219 days.

(21) Appl. No.: 13/953,445

(22) Filed: Jul. 29, 2013

(65) Prior Publication Data

US 2014/0078007 A1 Mar. 20, 2014

(30) Foreign Application Priority Data

Sep. 20, 2012 (JP) ..... 2012-206784
Sep. 20, 2012 (JP) ..... 2012-206864

(51) Int. Cl.

*H01Q 1/12* (2006.01)
*H01Q 9/04* (2006.01)
*H01Q 1/38* (2006.01)
*H01Q 1/27* (2006.01)

(52) U.S. Cl.

CPC ..... *H01Q 9/0407* (2013.01); *H01Q 1/273* (2013.01); *H01Q 1/38* (2013.01); *H01Q 9/0442* (2013.01); *H01Q 9/0471* (2013.01)

(58) Field of Classification Search

CPC ... H01Q 1/273; H01Q 9/0442; H01Q 9/0407; H01Q 1/38; H01Q 9/0471
USPC ..... 343/702, 700 MS, 718
See application file for complete search history.

(56) References Cited

U.S. PATENT DOCUMENTS

| | | | | |
|---|---|---|---|---|
| 5,155,493 | A * | 10/1992 | Thursby et al. | 343/700 MS |
| 5,734,350 | A * | 3/1998 | Deming et al. | 343/700 MS |
| 6,211,825 | B1 * | 4/2001 | Deng | 343/700 MS |
| 7,317,425 | B2 * | 1/2008 | Tanaka et al. | 343/718 |
| 8,421,678 | B2 | 4/2013 | Sakiyama et al. | |
| 2007/0229381 | A1 * | 10/2007 | Piisila et al. | 343/770 |
| 2013/0038492 | A1 * | 2/2013 | Abe | 343/700 MS |

FOREIGN PATENT DOCUMENTS

| | | | |
|---|---|---|---|
| CN | 1877906 | A | 12/2006 |
| CN | 101542835 | A | 9/2009 |
| JP | 2002-198725 | A | 7/2002 |
| JP | 2003258538 | A | 9/2003 |

OTHER PUBLICATIONS

Chinese Office Action (and English translation thereof) dated Apr. 23, 2015, issued in counterpart Chinese Application No. 2013104305767.

* cited by examiner

*Primary Examiner* — Hoanganh Le
(74) *Attorney, Agent, or Firm* — Holtz, Holtz, Goodman & Chick PC

(57) ABSTRACT

A patch antenna includes a dielectric body, radiation element, earth conductor and feed member. The dielectric body increases in cross-sectional area from a first end toward a second end thereof. The radiation element is disposed on a surface of the dielectric body, and each side of the radiation element has a length adjusted based on the frequency of a radio wave to be received and the effective permittivity of the dielectric body. The earth conductor is disposed on the bottom surface of the dielectric body. The feed member is electrically connected to the radiation element.

4 Claims, 24 Drawing Sheets

PATCH ANTENNA AND WIRELESS COMMUNICATIONS DEVICE

BACKGROUND OF THE INVENTION

1. Field of the Invention

The present invention relates to a patch antenna and a wireless communications device.

2. Description of the Related Art

Conventional wristwatch-type wireless terminals have a problem of degradation in antenna characteristics due to influence from a wrist where the wireless terminal is attached, for example.

For this reason, such a wireless terminal uses a patch antenna which has directivity in the zenith direction with respect to the GND surface thereof and is less influenced by a wrist where the wireless terminal is attached.

The patch antenna includes a dielectric body, a radiation element disposed on the top surface of the dielectric body, and an earth conductor disposed on the bottom surface of the dielectric body.

The technique of such a patch antenna is disclosed in, for example, Japanese Unexamined Patent Application Publication No. 2002-198725.

In general, a patch antenna occupies a larger space than other electronic components built in a wristwatch-type wireless terminal.

For this reason, in a wristwatch-type wireless terminal, a patch antenna is often mounted not in a main body case, where many electronic components are disposed and where there is not a sufficient space for the patch antenna, but in a band attaching portion, which affords more space for the patch antenna.

FIG. 12A is a plan view of a conventional wristwatch 600, and FIG. 12B is a side view thereof, a part of the wristwatch 600 cut out.

The wristwatch 600 includes a main body case 601, to which band attaching portions 601*a* and 601*b* are attached, and bands 602*a* and 602*b* attached to the band attaching portions 601*a* and 601*b*.

The main body case 601 and the band attaching portions 601*a* and 601*b* are formed in one united body with resin.

In the main body case 601, a GPS (global positioning system) module as a communication module is mounted, for example.

The band attaching portions 601*a* and 601*b* each have the shape of an isosceles trapezoid when viewed from above. More specifically, the widths of the band attaching portions 601*a* and 601*b* decrease in the direction from the main body case 601 toward the bands 602*a* and 602*b*, respectively.

Further, the bottom surfaces of the band attaching portions 601*a* and 601*b* are flush with the bottom surface of the main body case 601. The thicknesses (i.e., the heights of the top surfaces) of the band attaching portions 601*a* and 601*b* increase in the direction from the bands 602*a* and 602*b*, respectively, toward the main body case 601.

The band attaching portion 601*a* which is at the 6 o'clock position (i.e., 6 o'clock position of the analog watch) serves as an antenna case. A patch antenna 610 is encased within the band attaching portion 601*a*.

The expression "a patch antenna 610 is encased within the band attaching portion 601*a*" means a state where the patch antenna 610 is fitted (contained) in the band attaching portion 601*a* without protruding therefrom.

The patch antenna 610 has the shape of a square prism, and appears to be a square when viewed from above.

Further, the patch antenna 610 has a uniform thickness (i.e., constant height of the top surface).

The lengths of sides and thickness of the patch antenna 610 are constrained and determined on the basis of the smallest dimension within the space of the band attaching portion 601*a*.

Specifically, the lengths of sides of the patch antenna 610 are determined in accordance with the depth (i.e., the distance between the main body case 601 and the band 602*a*) of the band attaching portion 601*a*, the depth being smaller than its width; and the thickness of the patch antenna 610 is determined in accordance with the smallest height of the band attaching portion 601*a*.

Therefore, when the depth and the smallest height of the band attaching portion 601*a* are small, the size of the patch antenna 610 is restricted in accordance with the depth and the height. This reduces the volume of antenna, resulting in insufficient sensitivity characteristics (antenna gain).

SUMMARY OF THE INVENTION

An object of the present invention is to provide a patch antenna which can make efficient use of the space in an antenna case where the patch antenna is encased even when a dimension of the antenna case increases from its one end toward the other end to enhance sensitivity characteristics; and to provide a wireless communications device where the patch antenna is mounted.

According to a first aspect of the present invention, there is provided a patch antenna including: a dielectric body which increases in cross-sectional area from a first end toward a second end thereof; a radiation element which is disposed on a surface of the dielectric body and each side of which has a length adjusted based on a frequency of a radio wave to be received and an effective permittivity of the dielectric body; an earth conductor disposed on a bottom surface of the dielectric body; and a feed member electrically connected to the radiation element.

According to a second aspect of the present invention, there is provided a wireless communications device including a patch antenna and a containing portion which contains the patch antenna, the patch antenna including: a dielectric body which increases in cross-sectional area from a first end toward a second end thereof; a radiation element which is disposed on a surface of the dielectric body and each side of which has a length adjusted based on a frequency of a radio wave to be received and an effective permittivity of the dielectric body; an earth conductor disposed on a bottom surface of the dielectric body; and a feed member electrically connected to the radiation element, wherein the containing portion has a shape corresponding to a shape the patch antenna when viewed from above and/or when viewed from a side.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DETAILED DESCRIPTION OF THE PREFERRED EMBODIMENTS

First Embodiment

A patch antenna and a wireless communications device (wristwatch) in a first embodiment of the present invention are described below.

Figure 1A:
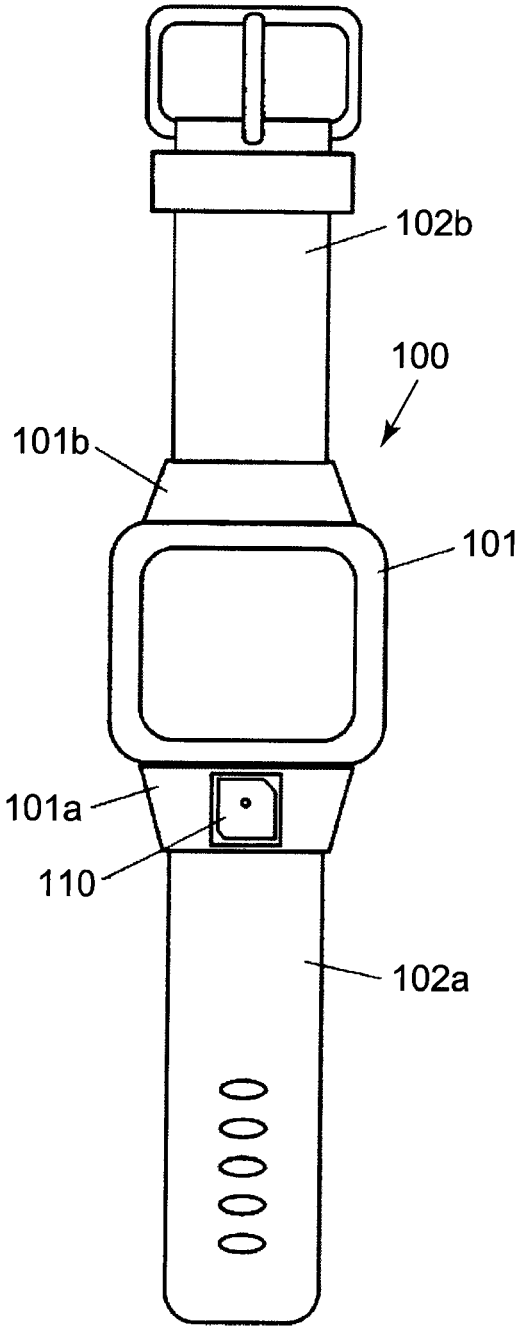
FIG. 1A is a plan view of a wristwatch in a first embodiment.
Figure 1B:
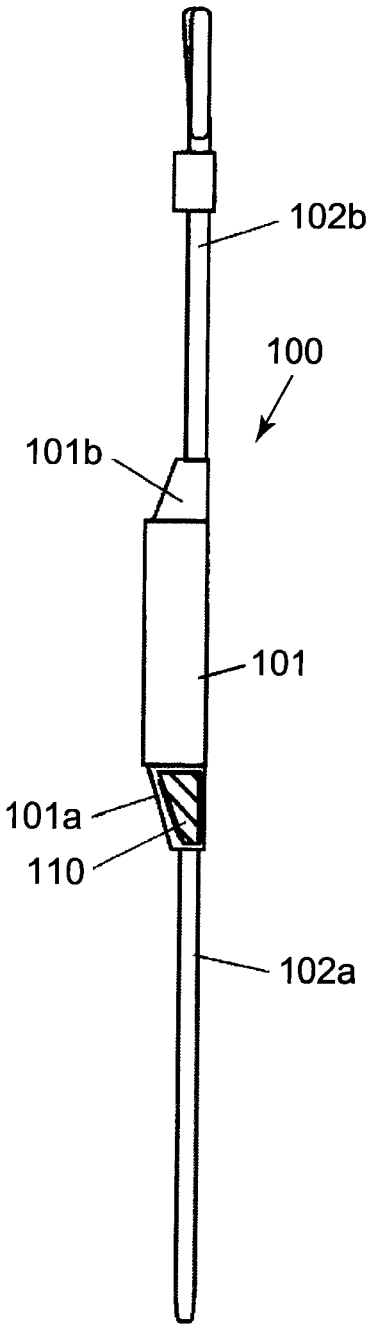
FIG. 1B is a side view of the wristwatch in the first embodiment, a part of the wristwatch cut out.

FIG. 1A is a plan view of a wristwatch 100; and FIG. 1B is a side view of the wristwatch 100, with a part of the wristwatch 100 cut out.

The wristwatch 100 includes a main body case 101 and bands 102*a* and 102*b*. Band attaching portions 101*a* and 101*b* are attached to the main body case 101 so that the portions 101*a* and 101*b* are at the positions corresponding to the 6 o'clock position and the 12 o'clock position, respectively, of the analog watch. The bands 102*a* and 102*b* are attached to the band attaching portions 101*a* and 101*b*, respectively.

The main body case 101 and the band attaching portions 101*a* and 101*b* are formed in one united body with resin.

The main body case 101 includes a built-in communication module.

The communication module receives a circular polarized wave of the GPS, for example.

The band attaching portions 101*a* and 101*b* of the wristwatch 100 each have the shape of an isosceles trapezoid when viewed from above. More specifically, the widths of the band attaching portions 101*a* and 101*b* decrease in the direction from the main body case 101 toward the bands 102*a* and 102*b*, respectively.

Further, the bottom surfaces of the band attaching portions 101*a* and 101*b* are flush with the bottom surface of the main body case 101. The thicknesses (i.e., the heights of the top surfaces) of the band attaching portions 101*a* and 101*b* increase in the direction from the bands 102*a* and 102*b*, respectively, toward the main body case 101.

The top surfaces of the band attaching portions 101*a* and 101*b* are inclined planes which are inclined upward in the direction from the bands 102*a* and 102*b*, respectively, toward the main body case 101.

The band attaching portion 101*a* which is at the 6 o'clock position (i.e., 6 o'clock position of the analog watch) of the two portions 101*a* and 101*b* serves as an antenna case. A patch antenna 110 is encased within the band attaching portion 101*a*.

The expression "a patch antenna 110 is encased within the band attaching portion 101*a*" means a state where the patch antenna 110 is fitted (contained) in the band attaching portion 101*a* without protruding therefrom.

Figure 2:
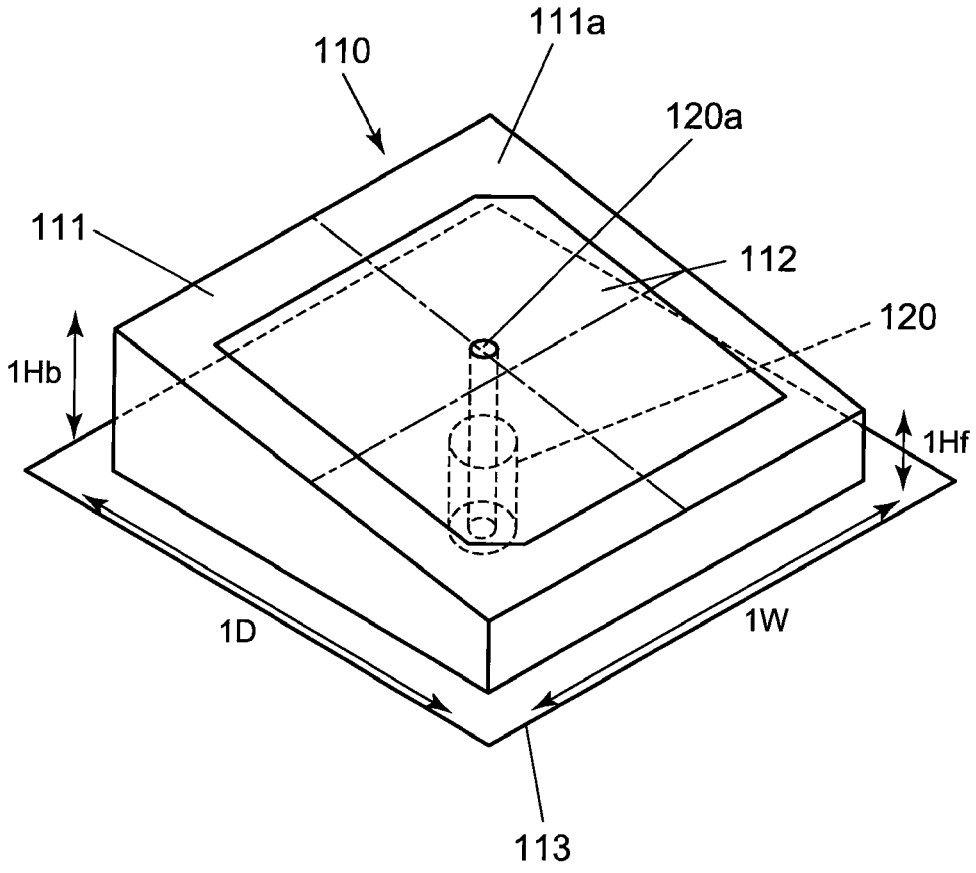
FIG. 2 is a perspective view of a patch antenna of the wristwatch shown in FIGS. 1A and 1B.
Figure 3:
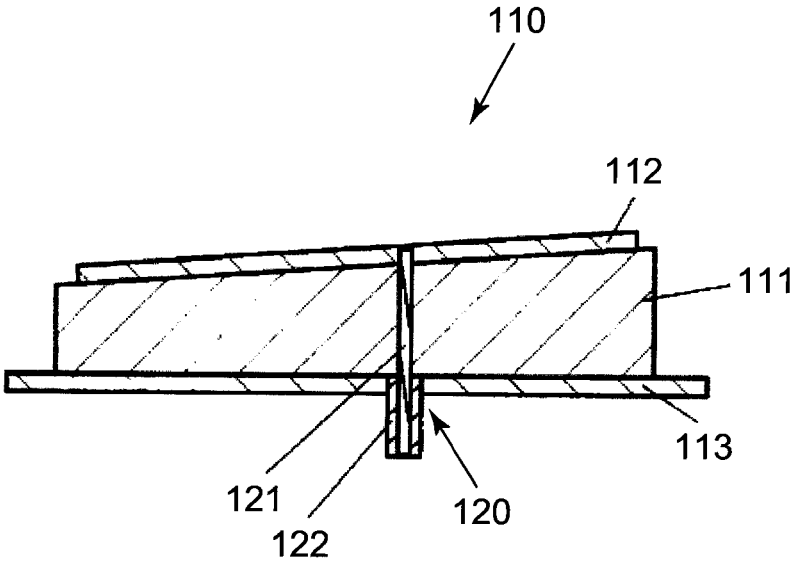
FIG. 3 is a side view of the mounted patch antenna shown in FIG. 2.

FIG. 2 is a perspective view of the patch antenna 110; and FIG. 3 is a side view of the mounted patch antenna 110 shown in FIG. 2.

The patch antenna 110 includes a dielectric body 111 having the shape of a square when viewed from above.

Further, the thickness (i.e., the height of the top surface) of the patch antenna 110 increases from its one end toward the other end when viewed from the side.

That is, the top surface of the patch antenna 110 is an inclined plane which is inclined upward from the one end toward the other end.

The patch antenna 110 includes the dielectric body 111, a radiation element 112 disposed on the top surface of the dielectric body 111, and an earth conductor 113 disposed on the bottom surface of the dielectric body 111.

The dielectric body 111 is made of ceramic, for example.

Further, the thickness (i.e., the height of the top surface) of the dielectric body 111 increases from its one end (first end) toward the other end (second end) when viewed from the side.

That is, the top surface of the dielectric body 111 is an inclined plane 111*a* which is inclined upward from the one end toward the other end.

When viewed from the direction perpendicular to the inclined plane 111*a*, the inclined plane 111 appears to have the shape of a rectangle.

When viewed from the direction perpendicular to the inclined plane 111*a* of the dielectric body 111, the radiation element 112 appears to have the shape of a square with a pair of diagonally-opposed corners thereof cut off.

The radiation element 112 is made of beaten silver, a metal plate or a metal film having a predetermined thickness, for example.

The radiation element 112 is formed on the top surface of the inclined plane 111*a* of the dielectric body 111 so as to have a uniform thickness.

The main four sides of the radiation element 112 are opposed to the four sides of the inclined plane 111*a* of the dielectric body 111, respectively, on a one-to-one basis so that the opposed sides in each pair are parallel to each other.

The earth conductor 113 is larger in size than the dielectric body 111 when viewed from above.

The earth conductor 113 is made of beaten silver, a metal plate or a metal film having a predetermined thickness, for example. In this embodiment, the earth conductor 113 is made of a metal plate.

The earth conductor 113 may be provided only on the bottom surface of the dielectric body 111. In this case, the earth conductor 113 is provided on the whole of the bottom surface of the dielectric body 111 except for the place where a coaxial cable 120 is disposed.

Another earth conductor may be further provided under the earth conductor 113, and the earth conductor 113 may be grounded through the other earth conductor.

The coaxial cable 120 as a feed member is disposed so as to penetrate through the earth conductor 113 and the dielectric body 111.

The core (inner conductor) 121 of the coaxial cable 120 is electrically connected to the radiation element 112 with solder (not shown).

The position (feed position) where the core 121 is connected to the radiation element 112 is the position which achieves impedance matching and which allows electrical currents perpendicular to each other having a phase difference of 90 degrees to flow on the radiation element 112 to receive a circular polarized wave.

The feed position is indicated by sign 120*a*.

The outer conductor 122 of the coaxial cable 120 is electrically connected to the earth conductor 113 with solder (not shown).

Here, a one-point feeding method is employed using the radiation element 112 having the shape of a square with a pair of diagonally-opposed corners thereof cut off. Alternatively, a one-point feeding method using a rectangular-shaped radiation element 112 may be employed. Further alternatively, a two-point feeding method may be employed using a rectangular- or square-shaped radiation element 112 with hybrid lines.

The point is the patch antenna 110 is designed to receive a circular polarized wave.

Further, the radiation element 112 may be fed with a feed pin as a feed member, instead of the coaxial cable 120.

The patch antenna 110 having the above-described structure is mounted in the band attaching portion 101*a* so that the direction of increase in thickness (i.e., the height of the top surface) of the patch antenna 110 coincides with the direction of increase in thickness (i.e., the height of the top surface) of the band attaching portion 101*a* and so that the patch antenna 110 is encased within the band attaching portion 101*a*, as shown in FIG. 1B.

The portion, above the patch antenna 110, of the band attaching portion 101*a* is preferably covered with radio-wave permeable resin to protect the patch antenna 110.

The wristwatch 100 having the structure as described above has the following effects.

Since the patch antenna 110 is encased within the band attaching portion 101*a* of the wristwatch 100, the patch antenna 110 does not protrude from the top surface of the band attaching portion 101*a*. This means the patch antenna 110 does not compromise the design of the wristwatch 100.

Further, since the direction of increase in height of the top surface of the patch antenna 110 coincides with the direction of increase in height of the top surface of the band attaching portion 101*a*, the space within the band attaching portion 101*a* can be effectively used.

Such a structure also improves sensitivity characteristics (antenna gain) because the patch antenna in the wristwatch 100 can have a larger volume than a conventional patch antenna which has a constant height of its top surface and is encased within an antenna case.

Further, since the space between the top surface of the band attaching portion 101*a* and the top surface of the patch antenna 110 is small, the design of the wristwatch 100 is not compromised when the patch antenna 110 is visible externally.

In order to ascertain the enhancement of sensitivity characteristics (antenna gain), performance evaluation of a GPS receiving antenna was made through a field simulation.

Figure 4:
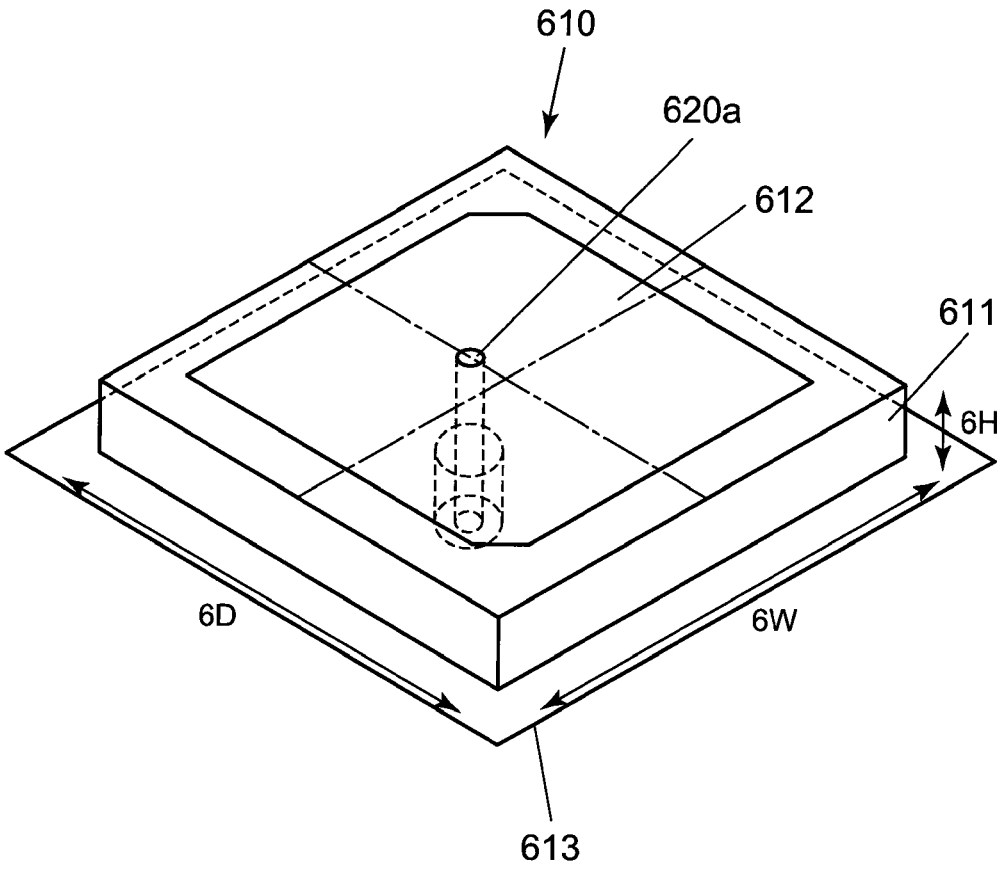
FIG. 4 is a perspective view showing a simulation model of a conventional patch antenna.

FIG. 4 illustrates a simulation model of a conventional patch antenna 610.

The simulation model of the patch antenna 610 has the shape of a quadrangular prism.

The dielectric body 611 of the simulation model of the patch antenna 610 has a constant thickness (6H) of 2 mm, a depth (6D) of 12 mm and a width (6W) of 12 mm. The radiation element 612 has a depth of 10 mm and a width of 10 mm.

The radiation element 612 has the shape of a square with a pair of diagonally-opposed corners thereof cut off. The radiation element 612 is formed on the top surface of the dielectric body 611, and the main four sides of the radiation element 612 are opposed to the four sides of the dielectric body 611, respectively, on a one-to-one basis so that the opposed sides in each pair are parallel to each other.

Since a patch antenna having this size normally has a relative permittivity of about 90-95, the relative permittivity is set to 93 here and the frequency is set to 1.575 GHz.

In FIG. 4, sign 613 indicates an earth conductor equivalent to the earth conductor 113, and sign 620*a* indicates a feed position.

Figure 5:
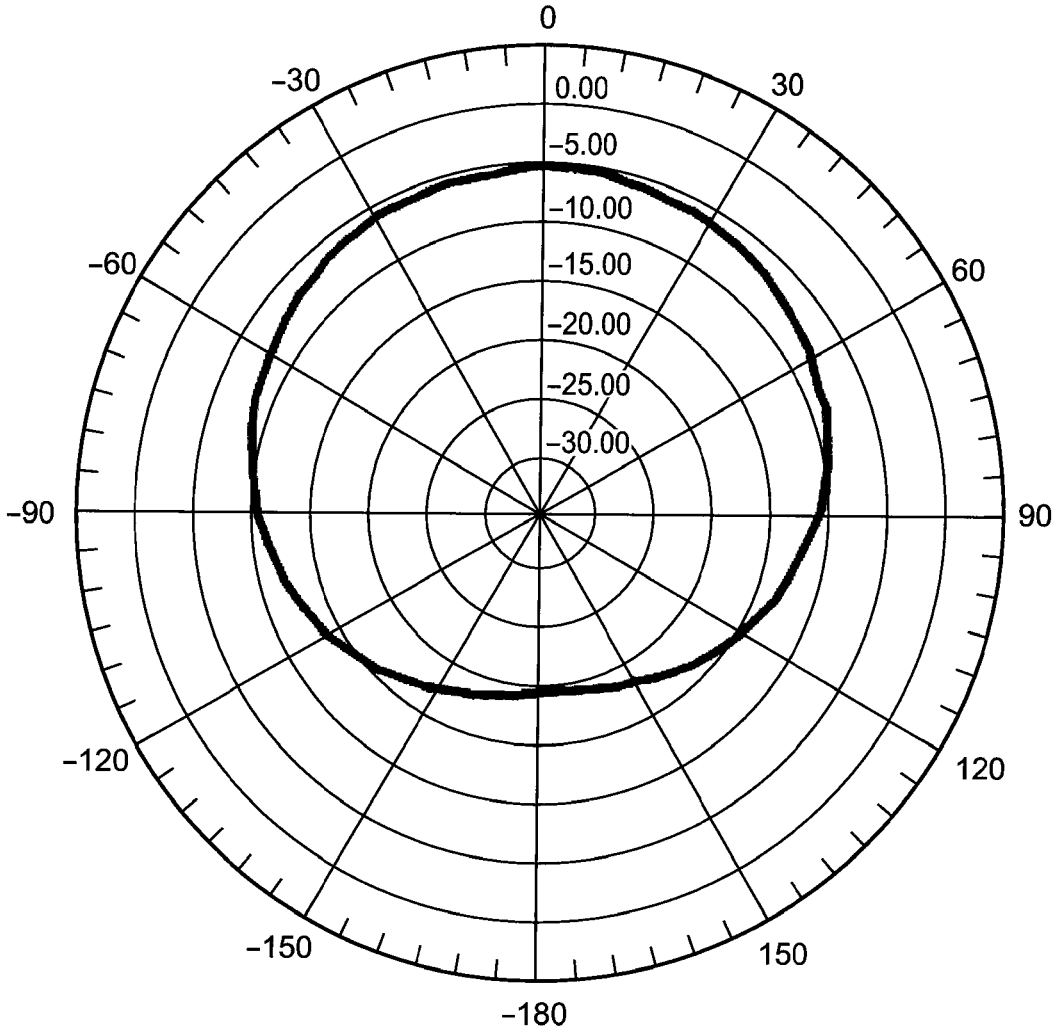
FIG. 5 illustrates the radiation pattern of the patch antenna shown in FIG. 4.

FIG. 5 illustrates the radiation pattern of the simulation model of the patch antenna 610 for a right handed polarized wave.

With the simulation model of the patch antenna 610, the antenna gain in the direction perpendicular to the GND surface (i.e., the direction perpendicular to the top surface of the earth conductor 613 or zenith direction) was −5.7 dBic.

In contrast, a performance evaluation through a simulation was made using the patch antenna 110 shown in FIG. 2 as a simulation model in the present embodiment.

The dielectric body 111 of the simulation model of the patch antenna 110 has a thickness of 2 mm at the thinnest portion (1Hf) and 4 mm at the thickest portion (1Hb) thereof, with the top surface of the dielectric body 111 being constantly-inclined. The dielectric body 111 has a depth (1D) of 12 mm and a width (1W) of 12 mm. The depth of the radiation element 112 along the inclined plane 111*a* is 10 mm, and the width of the radiation element 112 is 10 mm.

The relative permittivity is set to 76 and the frequency is set to 1.575 GHz.

Figure 6:
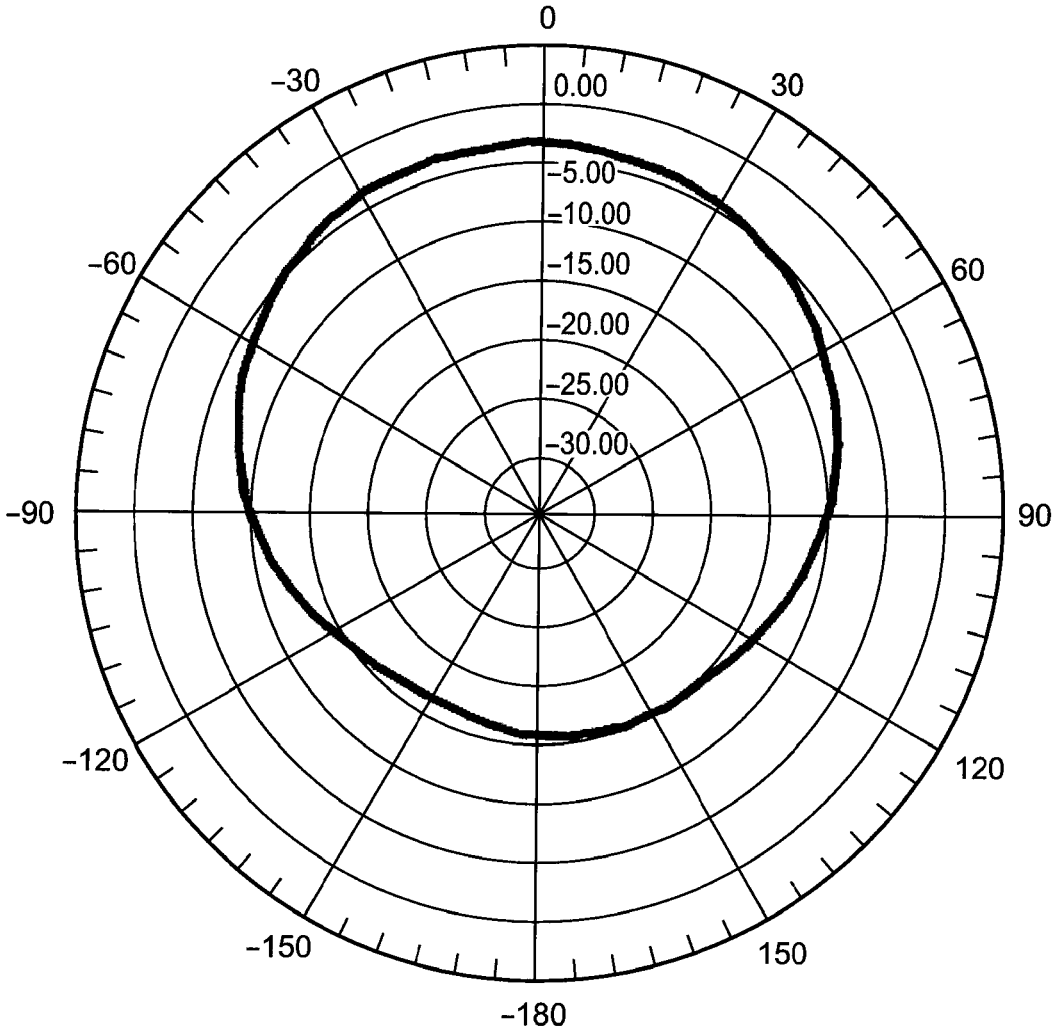
FIG. 6 illustrates the radiation pattern of a simulation model of the patch antenna shown in FIG. 2.

FIG. 6 illustrates the radiation pattern of the simulation model of the patch antenna 110 for a right handed polarized wave.

With the simulation model of the patch antenna 110, the antenna gain in the direction perpendicular to the GND surface (i.e., the direction perpendicular to the top surface of the earth conductor 113 or zenith direction) was −3.9 dBic.

That is, the simulation model of the patch antenna 110 produced 1.8 dB gain increase in comparison with the simulation model of the conventional patch antenna 610.

The advantageous effects have been described obtained in the case where the patch antenna 110 has an inclined top surface and the dielectric body 111 has the same plane area as the dielectric body of the conventional patch antenna 610.

From another point of view, the following advantageous effects can be obtained. That is, when the patch antenna 110 has an inclined top surface and a radiation plane (i.e., the plane, on which the radiation element is formed, of the dielectric body) has an area equal to that of the conventional patch antenna 610, the length of each side of the dielectric body 111 can be shorter, leading to downsizing of the dielectric body 111.

For example, when the conventional patch antenna 610 having the shape of a square prism includes the dielectric body 611 whose radiation plane has a depth of 12 mm and a width of 12 mm, the dielectric body 611 projected on the GND surface has a depth of 12 mm and a width of 12 mm.

In contrast, when the patch antenna 110 has a radiation plane whose area is equal to that of the conventional patch antenna 610, the radiation plane of the dielectric body 111 projected on the GND surface has a smaller size than that of the conventional patch antenna 610 because the top surface (radiation plane) of the dielectric body 111 is an inclined plane. More specifically, the radiation plane of the dielectric body 111 projected on the GND surface has the shape of a rectangle with a depth of 11.8 mm and a width of 12 mm.

That is, the patch antenna 110 whose top surface is inclined has a depth 0.2 mm smaller than that of the conventional patch antenna 610 when the radiation planes of both antennas 110 and 610 have the same area.

(First Modification)

Figure 7:
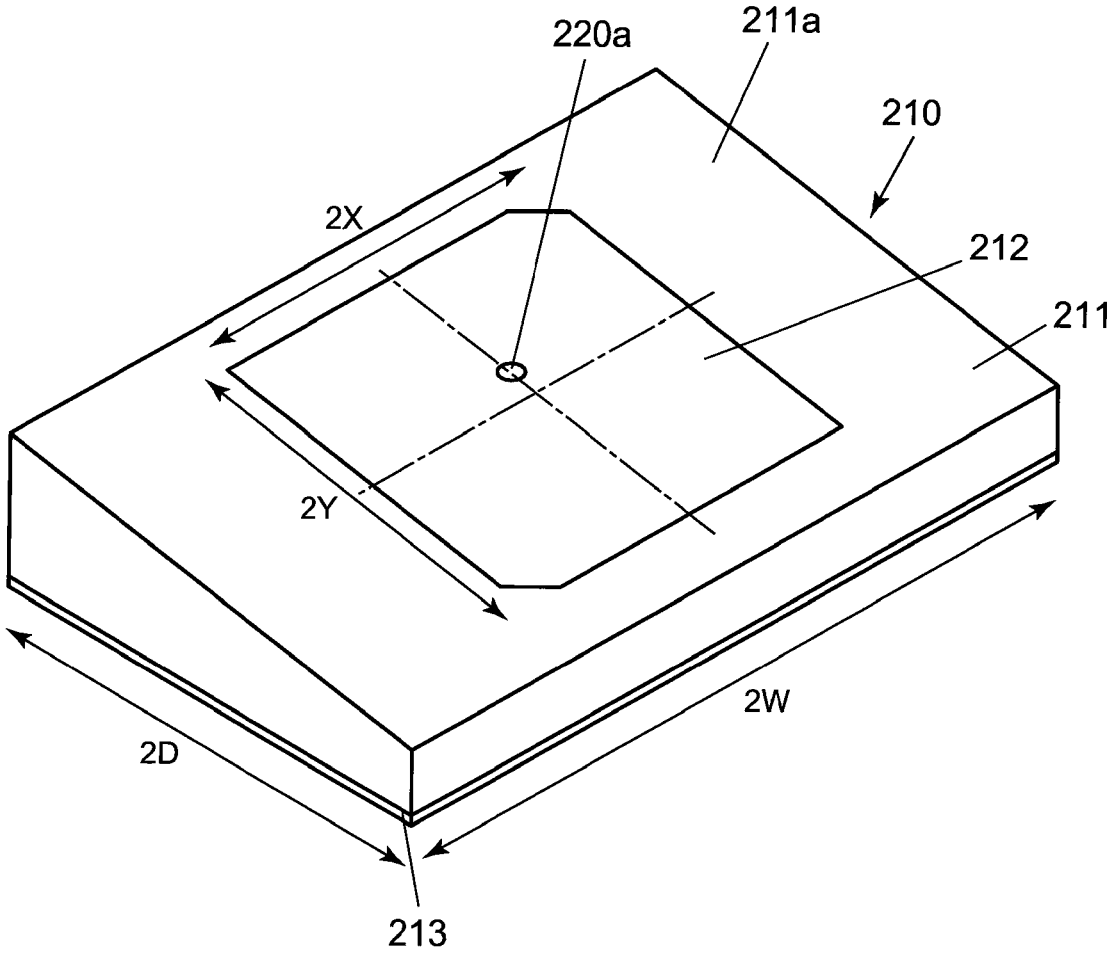
FIG. 7 is a perspective view of a patch antenna in a first modification of the first embodiment.

FIG. 7 illustrates a patch antenna 210 in a first modification.

The patch antenna 210 includes a dielectric body 211 whose top surface forms an inclined plane 211*a* which is inclined upward from one end (first end) toward the other end (second end) of the dielectric body 211.

The dielectric body 211 has a width larger than its depth. When viewed from the direction perpendicular to the top surface of a radiation element 212, the radiation element 212 appears to have the shape of a rectangle with a pair of diagonally-opposed corners thereof cut off.

In FIG. 7, sign 220*a* indicates a feed position.

The patch antenna 210 having such a structure is advantageous when a space for the patch antenna 210 in an antenna case can be expanded in the direction perpendicular to the direction of inclination of its top surface.

The band attaching portion 101*a* of FIG. 1, for example, includes a vacant space extending in the direction perpendicular to the direction of inclination of its top surface.

In such a case, using the patch antenna 210 having a larger volume leads to enhancement of sensitivity characteristics (antenna gain).

Even when the volume of antenna is the same, antenna gain can also be enhanced by making the area of the radiation element 212 larger.

In order to ascertain the enhancement of its antenna gain, performance evaluation was made through a field simulation using the patch antenna 210 shown in FIG. 7 as a simulation model.

The dielectric body 211 of the simulation model of the patch antenna 210 has a thickness of 2 mm at the thinnest portion and 4 mm at the thickest portion thereof.

The dielectric body 211 has a depth (2D) of 12 mm and a width (2W) of 18 mm.

The radiation element 212 substantially has the shape of a rectangle. The depth (2Y) along the inclined plane of the radiation element 212 is 11 mm, and the width (2X) thereof is 10 mm.

Compared with the dielectric body 611 of the conventional patch antenna 610, the dielectric body 211 has the same vertical size and 6 mm larger in horizontal size.

The depth and width of the radiation element 212 are the dimensions along the inclined plane 211*a*.

Next, detailed descriptions are given for the radiation element 212 having a larger area.

When an antenna includes a dielectric body, the length M0 of a side of the radiation element corresponding to an antenna resonant frequency is expressed by the relational expression of $M0=c/(2\times f0\times\sqrt{(\in e)})$, where f0 is the resonant frequency, $\in e$ is the effective permittivity of the dielectric body, and c is the velocity of light.

Therefore, to make the area of the radiation element larger, the length of a side of the radiation element should satisfy the mode condition for the resonant frequency and the radiation element should not protrude from the inclined plane of the dielectric body.

Since the dielectric body 211 has a width larger than its depth, the effective permittivity of the dielectric body 211 for the radiation element 212 is larger in the width direction than in the depth direction, and the radiation element is shorter in width than in depth.

The antenna dielectric body of the patch antenna 210 has a relative permittivity ($\in a$) smaller than that of the conventional patch antenna 610 so that the radiation element 212 does not protrude from the inclined plane 211*a*.

Specifically, the relative permittivity ($\in a$) of the antenna dielectric body is set to 76.

Figure 8:
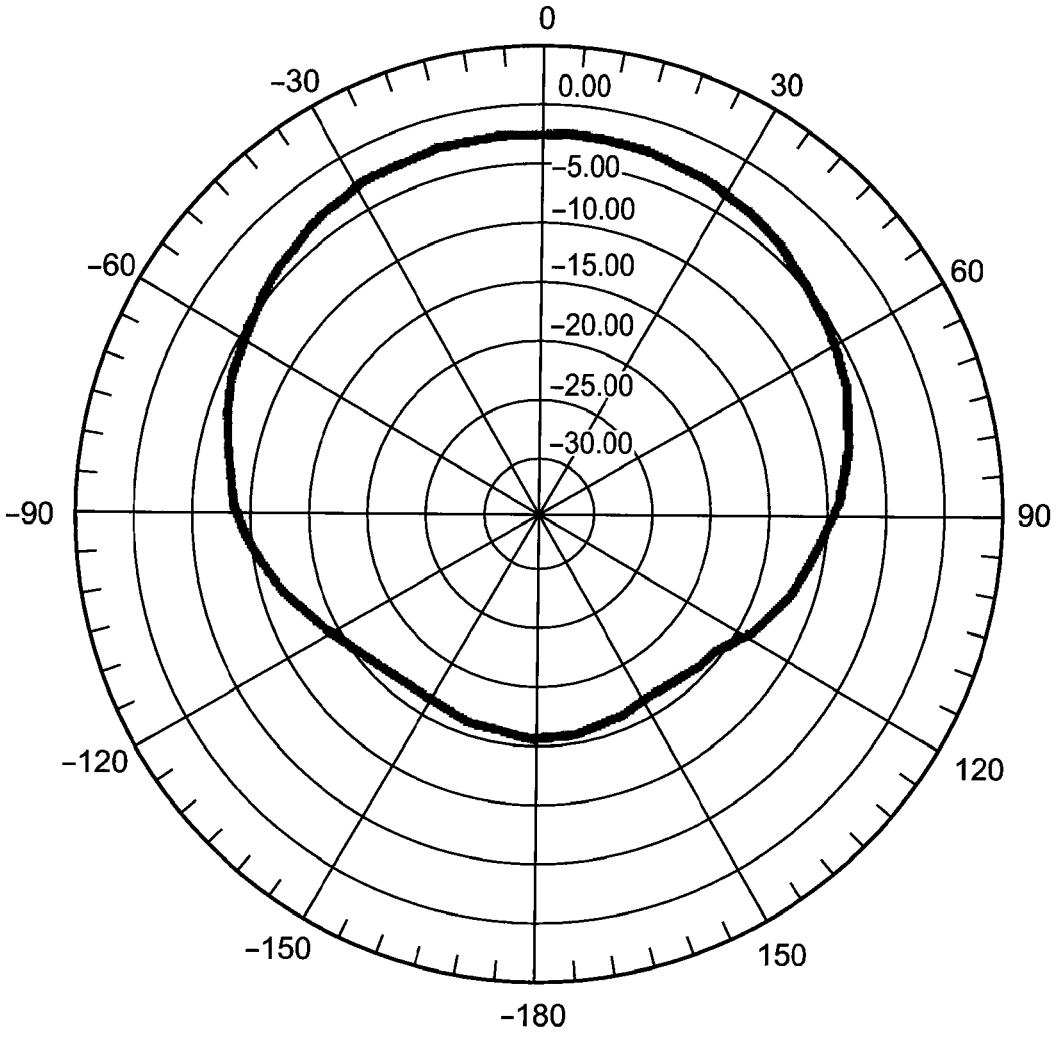
FIG. 8 illustrates the radiation pattern of a simulation model of the patch antenna shown in FIG. 7.

FIG. 8 illustrates the radiation pattern of the simulation model of the patch antenna 210 for a right handed polarized wave.

With the simulation model of the patch antenna 210, the antenna gain is the maximum in the zenith direction relative to the GND surface as in the simulation model of the conventional patch antenna 610 although the radiation element 212 inclines relative to the GND surface.

In this case, the antenna gain in the zenith direction of the simulation model of the patch antenna 210 was −2.7 Bic. That is, the simulation model of the patch antenna 210 produced 3.0 dB gain increase in comparison with the simulation model of the conventional patch antenna 610 having a thickness of 2 mm.

(Second Modification)

Figure 9:
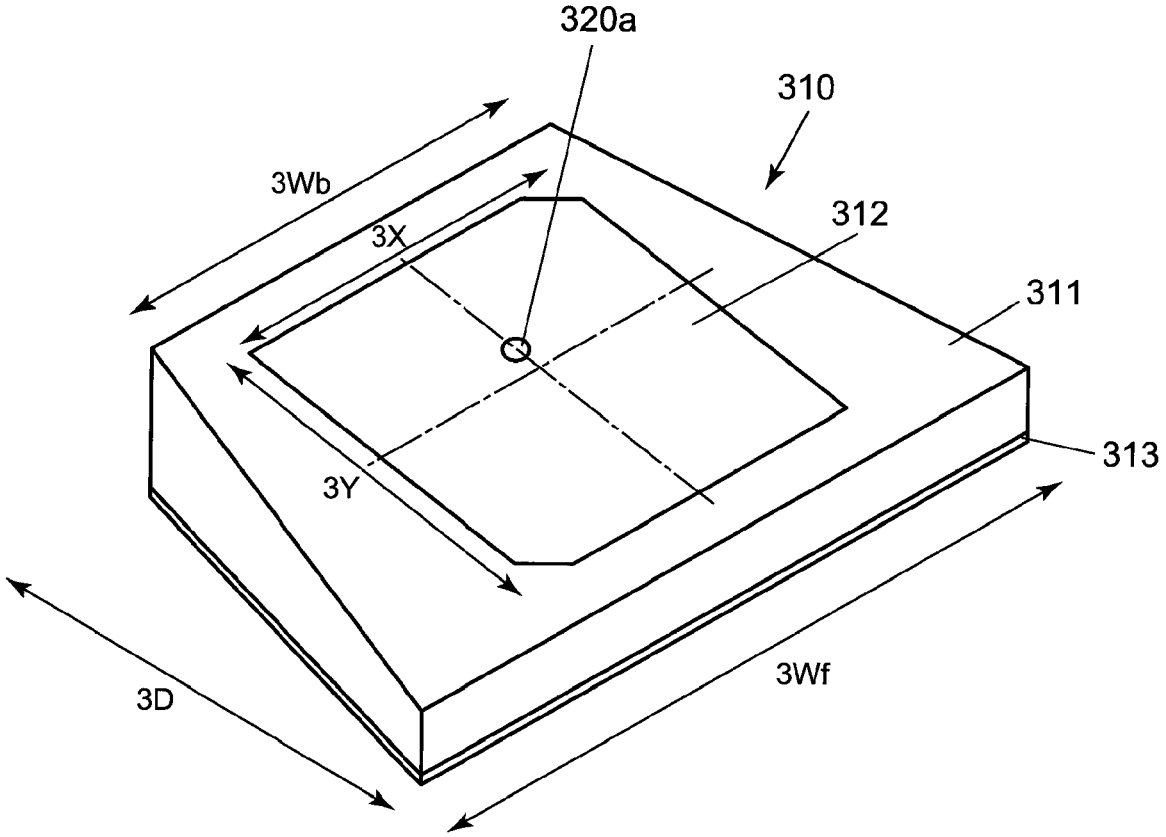
FIG. 9 is a perspective view of a patch antenna in a second modification of the first embodiment.

FIG. 9 illustrates a patch antenna 310 in a second modification.

The patch antenna 310 includes a dielectric body 311 whose width increases as the thickness decreases and which has the shape of an isosceles trapezoid when viewed from above. Such a shape of the dielectric body 311 has been designed in view of the fact that the effective permittivity of a dielectric body differs depending on its thickness.

The dielectric body 311 has a depth (3D) of 12 mm, a width (3Wf) of 18 mm at the near side, and a width (3Wb) of 12 mm at the back side.

Further, a radiation element 312 substantially has the shape of a rectangle whose depth (3Y) along the inclined plane is 11 mm and width (3X) is 10 mm.

The depth and width of the radiation element 312 are the dimensions along the inclined plane.

In FIG. 9, the radiation element 312 and an earth conductor 313 are equivalent to the radiation element 112 and the earth conductor 113, respectively, of the patch antenna 110.

In FIG. 9, sign 320*a* indicates a feed position.

The dimensions of the dielectric body 311 are finely adjusted so that a thinner portion and a thicker portion of the dielectric body 311 have substantially the same effective permittivity. This makes the wavelength shortening effects of the thinner and thicker portions substantially the same.

(Third Modification)

Figure 10:
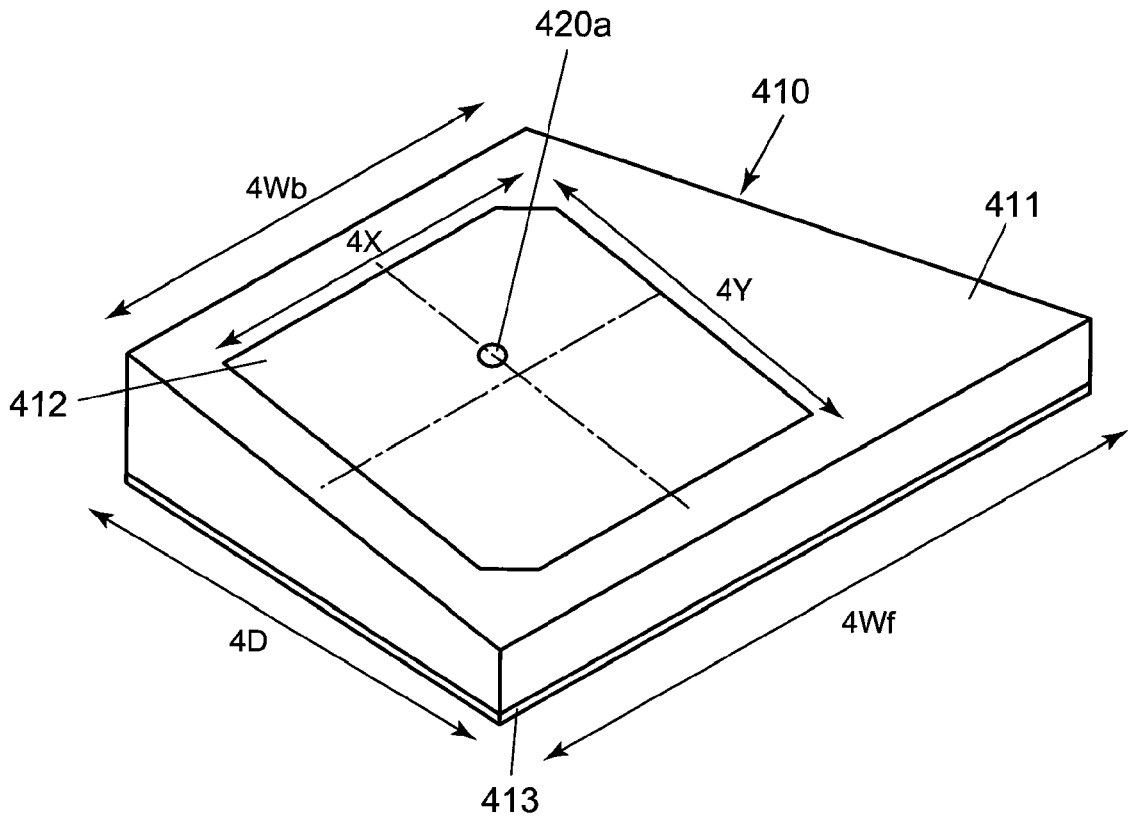
FIG. 10 is a perspective view of a patch antenna in a third modification of the first embodiment.

FIG. 10 illustrates a patch antenna 410 in a third modification.

While the patch antenna 310 in the second modification includes the dielectric body 311 having the shape of an isosceles trapezoid when viewed from above, the patch antenna 410 in the third modification includes a dielectric body 411 having the shape of a non-isosceles trapezoid with a pair of parallel sides. More specifically, one side of the dielectric body 411 is perpendicular to the pair of parallel sides of the dielectric body 411. Further, a radiation element 412 has the shape of a rectangle whose short sides are parallel to the pair of parallel sides, respectively, of the dielectric body 411.

The dielectric body 411 has a depth (4D) of 12 mm, a width (4Wf) of 18 mm at the near side, and a width (4Wb) of 12 mm at the back side.

Further, the radiation element 412 substantially has the shape of a rectangle whose depth (4Y) along the inclined plane is 11 mm and width (4X) is 10 mm.

The depth and width of the radiation element 412 are the dimensions along the inclined plane.

In FIG. 10, an earth conductor 413 is equivalent to the earth conductor 113 of the patch antenna 110.

In FIG. 10, sign 420*a* indicates a feed position.

The dimensions of the dielectric body 411 are finely adjusted so that a thinner portion and a thicker portion of the dielectric body 411 have substantially the same effective permittivity. This makes the wavelength shortening effects of the thinner and thicker portions of the dielectric body 411 substantially the same, as in the patch antenna 310.

(Fourth Modification)

Figure 11:
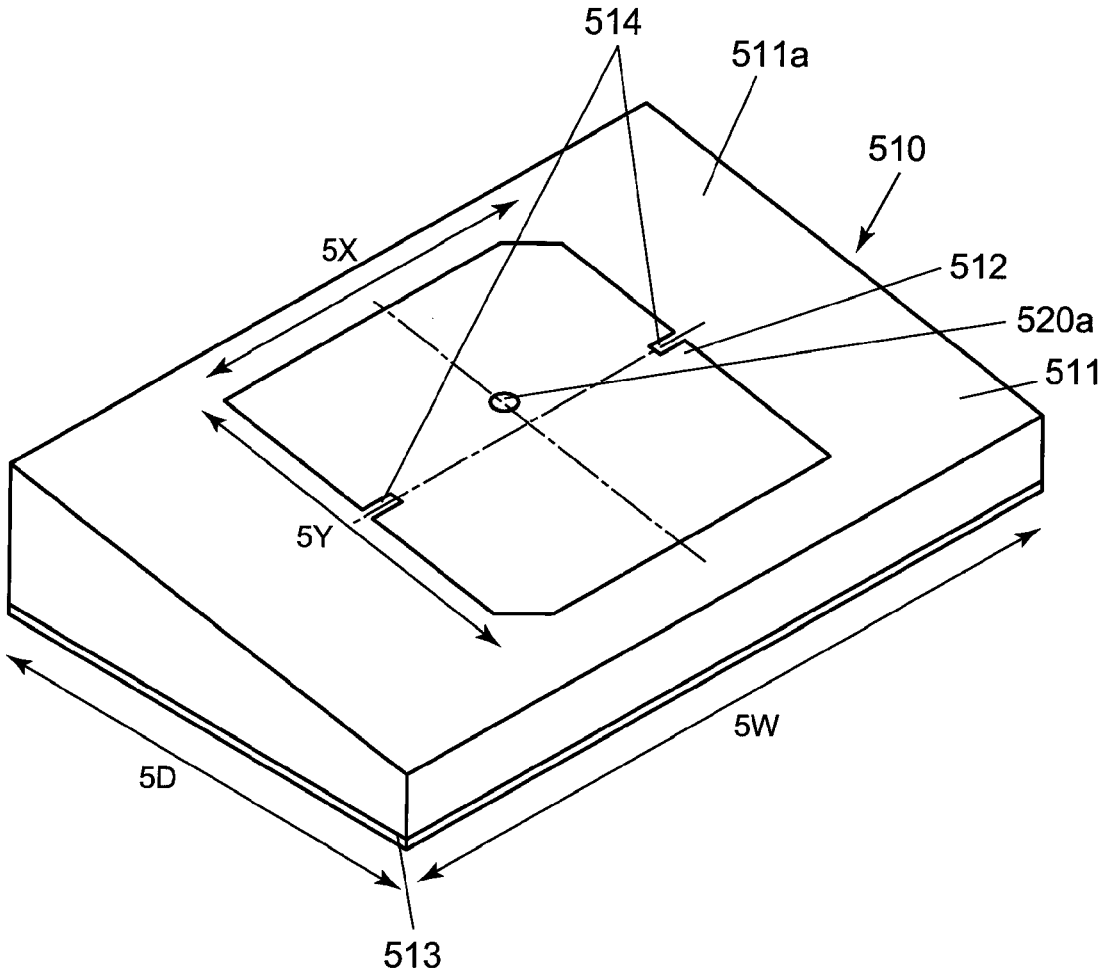
FIG. 11 is a perspective view of a patch antenna in a fourth modification of the first embodiment.
Figure 12A:
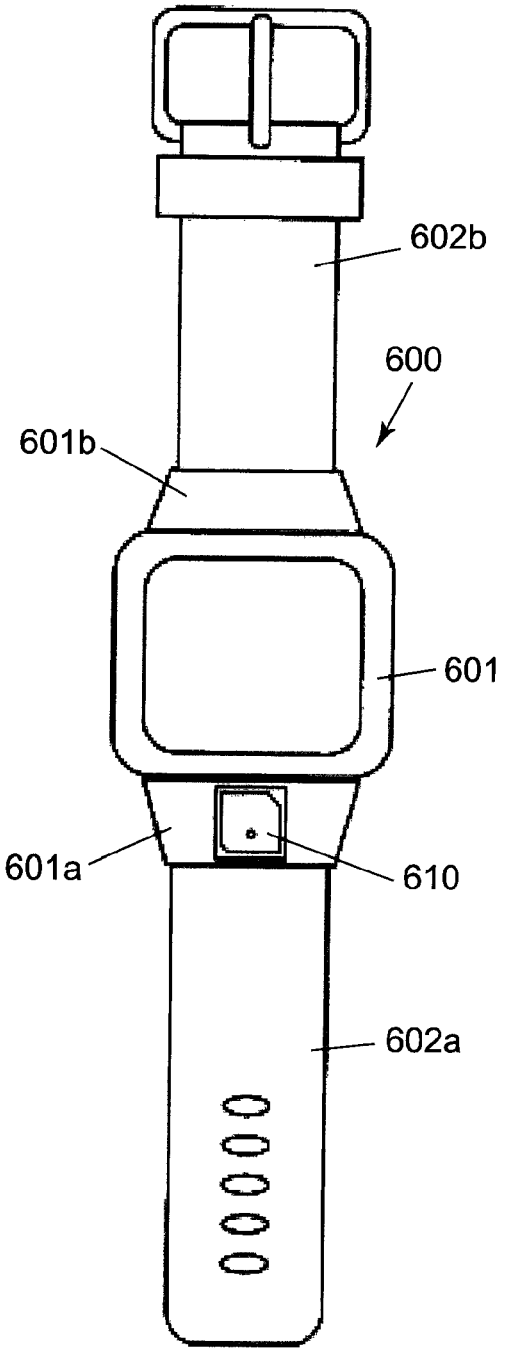
FIG. 12A is a plan view of a conventional wristwatch.
Figure 12B:
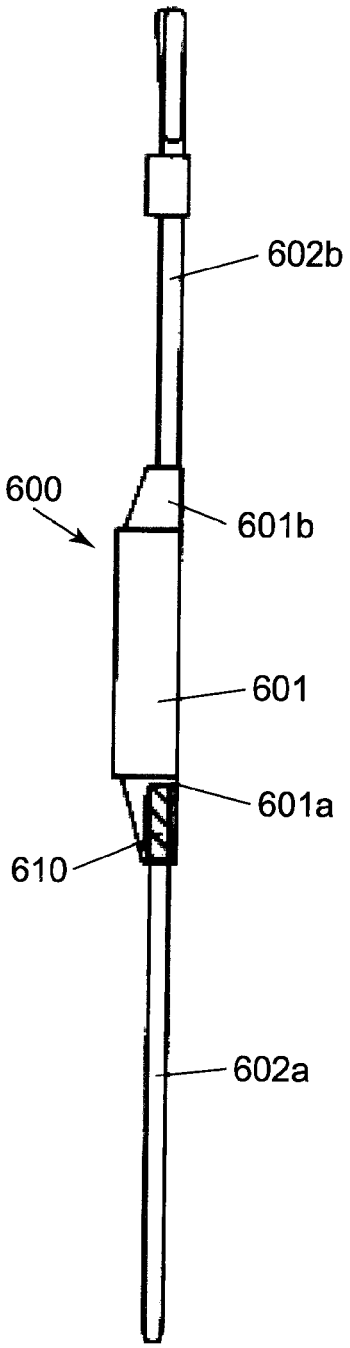
FIG. 12B is a side view of the conventional wristwatch, a part of the wristwatch cut out.

FIG. 11 illustrates a patch antenna 510 in a fourth modification.

The patch antenna 510 includes a dielectric body 511 whose top surface forms an inclined plane 511*a* which is inclined upward from one end (first end) toward the other end (second end) of the dielectric body 511.

The dielectric body 511 has a width larger than its depth.

Further, a slit 514 is provided at each of a pair of sides of a radiation element 512, the sides extending in the depth direction of the radiation element 512 and being opposed to each other. This allows the radiation element 512 to have the shape corresponding to a square when viewed from the direction perpendicular to the top surface of a radiation element 512.

The dielectric body 511 has a depth (5D) of 12 mm and a width (5W) of 18 mm.

The radiation element 512 substantially has the shape of a square whose depth (5Y) and width (5X) along the inclined plane are each 11 mm.

The depth and width of the radiation element 512 are the dimensions along the inclined plane.

In FIG. 11, sign 520*a* indicates a feed position.

The expression of "the radiation element 512 has the shape corresponding to a square" includes the case where the radiation element 512 has the shape of a perfect square and the case where the main four sides of the radiation element 512 lie along the respective sides of a square as in the fourth modification.

The patch antenna 510 having such a structure is advantageous when a space for the patch antenna 510 in an antenna case can be expanded in the direction perpendicular to the direction of inclination of its top surface.

Further, the substantially square-shaped radiation element 512 allows electrical currents perpendicular to each other having a phase difference of exactly 90 degrees to flow on the radiation element 512 to receive a circular polarized wave.

Even when the volume of antenna is the same, antenna gain can also be enhanced by making the area of the radiation element 512 larger.

In the above, various embodiments and their modifications of the present invention have been described. The present invention, however, is not limited to those embodiments and modifications but may be modified in various ways.

For example, according to the first to third modifications of the first embodiment, the radiation elements 212, 312 and 412 each have the shape of a rectangle with a pair of diagonally-opposed corners thereof cut off. Alternatively, each of the radiation elements 212, 312 and 412 may have the shape of a square with a pair of diagonally-opposed corners thereof cut off.

Further, the radiation element 512 of the fourth modification may be the one with no corners cut off.

In order to realize a patch antenna for a circular polarized wave, however, a feeding method and/or a feed position needs to be changed as appropriate.

Second Embodiment

A patch antenna and a wireless communications device (wristwatch) in a second embodiment of the present invention are described below with reference to FIGS. 13A-18B.

Figure 13A:
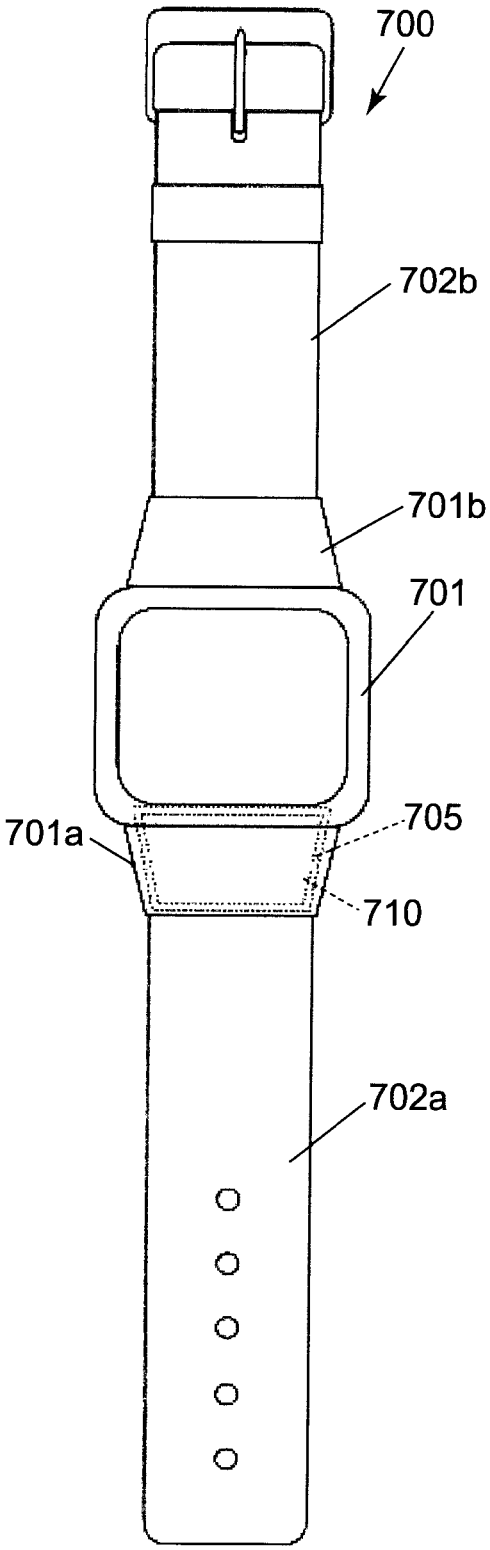
FIG. 13A is a plan view of a wristwatch in a second embodiment.
Figure 13B:
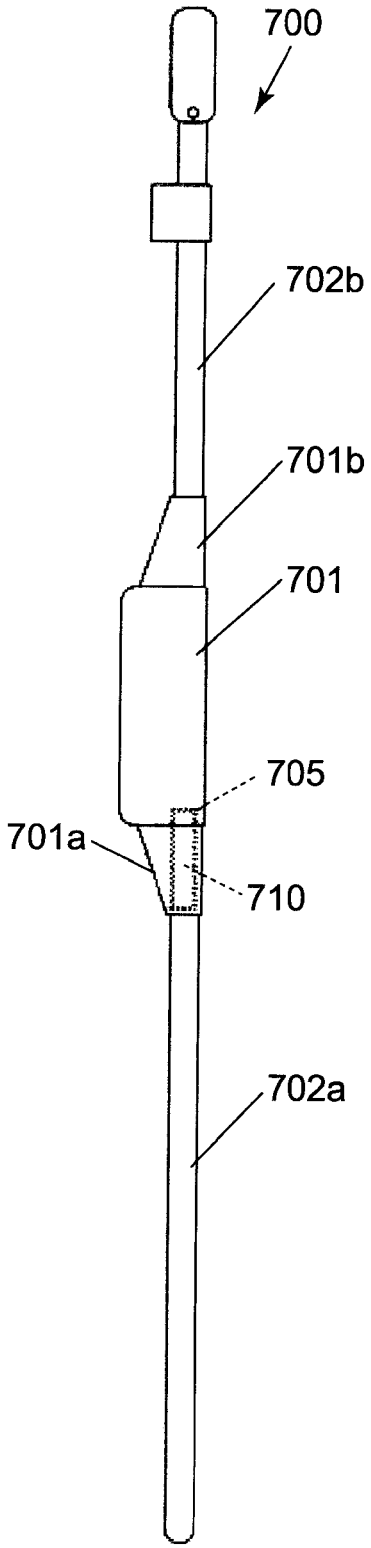
FIG. 13B is a side view of the wristwatch in the second embodiment.

FIG. 13A is a plan view of the wireless communications device (wristwatch) in the second embodiment; and FIG. 13B is its side view.

The internal structure which is not visible externally is indicated by a broken line.

The wristwatch 700 includes a main body case 701 and bands 702*a* and 702*b*. Band attaching portions 701*a* and 701*b* are attached to the main body case 701 so that the portions 701*a* and 701*b* are at the positions corresponding to the 6 o'clock position and the 12 o'clock position, respectively, of the analog watch. The bands 702*a* and 702*b* are attached to the band attaching portions 701*a* and 701*b*, respectively. The main body case 701 and the band attaching portions 701*a* and 701*b* are formed in one united body with resin.

The main body case 701 includes a built-in communication module (not shown), for example.

The communication module receives a circular polarized wave of the GPS, for example.

As shown in FIG. 13A, the band attaching portions 701*a* and 701*b* of the wristwatch 700 each have the shape of an isosceles trapezoid when viewed from above. More specifically, the widths of the band attaching portions 701*a* and 701*b* decrease in the direction from the main body case 701 toward the bands 702*a* and 702*b*, respectively.

Further, as shown in FIG. 13B, the bottom surfaces of the band attaching portions 701*a* and 701*b* are substantially flush with the bottom surface of the main body case 701. The thicknesses (i.e., the heights of the top surfaces) of the band attaching portions 701*a* and 701*b* increase in the direction from the bands 702*a* and 702*b*, respectively, toward the main body case 701.

That is, the top surfaces of the band attaching portions 701*a* and 701*b* form inclined planes which are inclined upward in the direction from the bands 702*a* and 702*b*, respectively, toward the main body case 701; and the band attaching portions 701*a* and 701*b* each have the shape of a trapezoid when viewed from the side.

A containing portion 705 to contain a patch antenna 710 is provided in the space in the band attaching portion 701*a* and a part of the main body case 701 adjacent to the band attaching portion 701*a* (i.e., the end portion of the main body case 701 on the side of the band attaching portion 701*a*). The patch antenna 710 is encased within the containing portion 705.

As shown in FIG. 13A, the containing portion 705 has the shape of an isosceles trapezoid, when viewed from above, along the shape of the space in the band attaching portion 701*a* and the end portion of the main body case 701 adjacent to the band attaching portion 701*a* in the present embodiment.

The height (thickness) of the containing portion 705 is adjusted to coincide with the smallest height (thickness) among the heights (thicknesses) of band attaching portion 701*a* and the end portion of the main body case 701.

In the present embodiment, the end of the band attaching portion 701*a* adjacent to the band 702*a* has the smallest height (thickness). Accordingly, the containing portion 705 is designed to have a height (thickness) a little smaller than the height (thickness) of the end of the band attaching portion 701*a*.

Figure 14A:
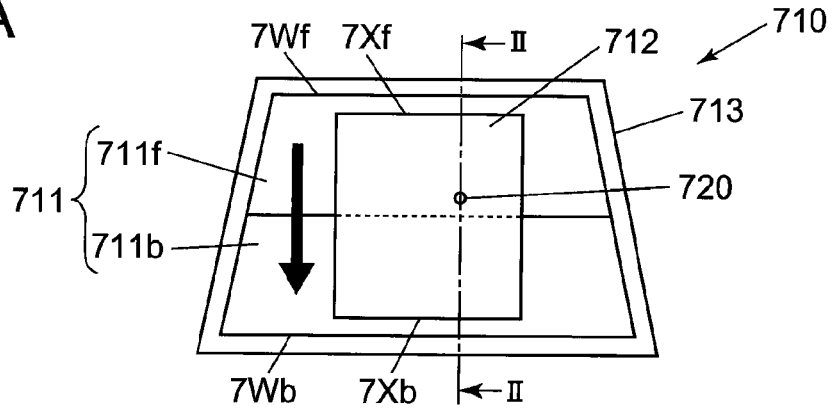
FIG. 14A is a plan view of a patch antenna to be mounted in the wristwatch shown in FIGS. 13A and 13B.
Figure 14B:
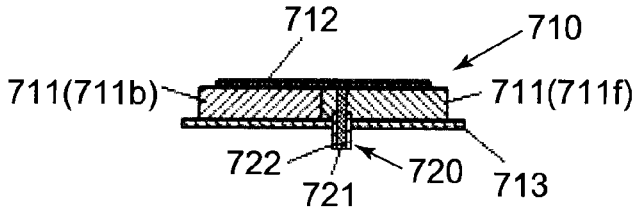
FIG. 14B is a cross-sectional view of the patch antenna shown in FIG. 14A along the line II-II.

FIG. 14A is a plan view of a patch antenna in the present embodiment; FIG. 14B is a cross-sectional view of the patch antenna along the line II-II of FIG. 14A; and FIG. 14C is a perspective view of the patch antenna shown in FIG. 14A.

As shown in FIG. 13A, the patch antenna 710 has the shape of an isosceles trapezoid along the shape of the containing portion 705 when viewed from above.

Further, the patch antenna 710 has the shape of a rectangle along the shape of the containing portion 705 when viewed from the side.

Figure 14C:
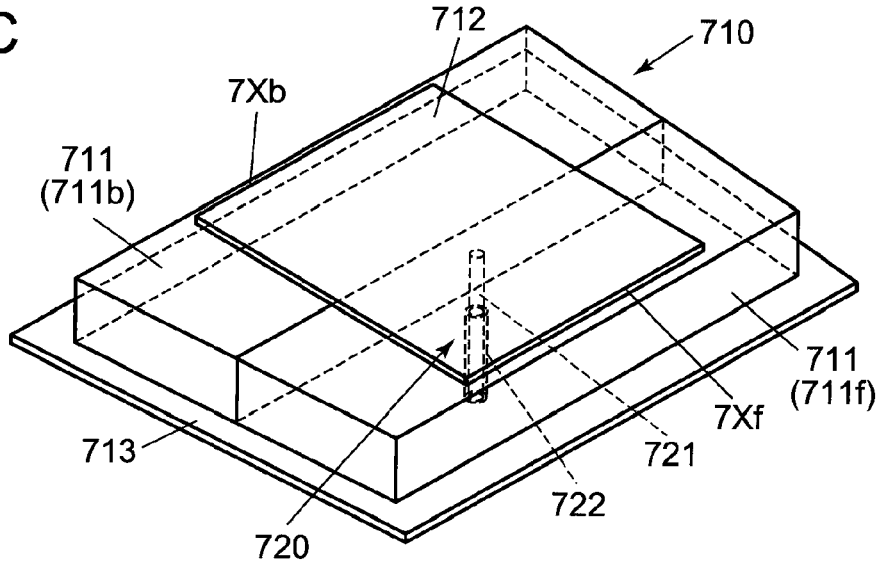
FIG. 14C is a perspective view of the patch antenna shown in FIG. 14A.

As shown in FIGS. 14A-14C, the patch antenna 710 includes a dielectric body 711, a radiation element 712 disposed on the top surface of the dielectric body 711, and an earth conductor 713 disposed on the bottom surface of the dielectric body 711.

The plane, on which the radiation element 712 is formed (i.e., the upper surface of the dielectric body 711 in FIG. 14B), of the patch antenna 710 is referred to as a radiation plane.

The dielectric body 711 has the shape of a tetragon when viewed from above. Specifically, the dielectric body 711 has rectangular-shaped lateral faces parallel to each other at its one end (first end) and the other end (second end), the cross-sectional area of the dielectric body 711 increasing from its one end toward the other end.

More specifically, the dielectric body 711 has two sides 7Wf and 7Wb parallel to each other; and the dielectric body 711 increases in width from one side 7Wf toward the other side 7Wb (i.e., in the direction of the bold arrow), as shown in FIG. 14A. The width of the dielectric body 711 means the dimension of the dielectric body 711 in the direction parallel to the sides 7Wf and 7Wb. In other words, the dielectric body 711 has the shape of a trapezoid (isosceles trapezoid in the present embodiment) when viewed from above. That is, the area of the longitudinal section increases from the side 7Wf toward the side 7Wb.

In the present embodiment, the height (thickness) of the dielectric body 711 is constant.

The dielectric body 711 includes a plurality of dielectric body units 711*f* and 711*b* bonded to each other, the units 711*f* and 711*b* having relative permittivities different from each other. In the present embodiment, the dielectric body unit 711*b* forms a first part of the dielectric body 711 with a larger cross-sectional area, and the dielectric body unit 711*f* forms a second part of the dielectric body 711 with a smaller cross-sectional area. Hereinafter, the first and second parts are referred to as larger and smaller cross section parts, respectively.

The dielectric body 711 is made of ceramic, for example. The dielectric body units 711*f* and 711*b* are made of ceramic with different compositions, and thus, have different relative permittivities.

The effective permittivity of the dielectric body 711 is adjusted by making the relative permittivities of the dielectric body units 711*b* and 711*f* different from each other. Specifically, the dielectric body unit 711*b* forming the larger cross section part has a relative permittivity smaller than that of the dielectric body unit 711*f* forming the smaller cross section part.

The relative permittivity is the ratio of the permittivity of a medium (i.e., ceramic in the present embodiment) to the permittivity of a vacuum, namely, the permittivity of a medium where the permittivity of air is 1. The volume of the dielectric body 711 is ignored, and the permittivity of the dielectric body 711 is determined depending on its material.

When the dielectric body 711 is made of ceramic, the relative permittivity of the dielectric body 711 is determined depending on the content of dielectric material contained in the ceramic.

The effective permittivity (effective permittivity $\in$) means a permittivity when the edge effect (peripheral electric field including air) of the dielectric body 711 is taken into consideration. When using the dielectric body 711 having the same relative permittivity, the effective permittivity decreases as the volume of the dielectric body 711 around the radiation element 712 decreases.

The radiation element 712 substantially has the shape of a rectangle when viewed from above. Specifically, the length L1 of the side 7Xf on one end and length L2 of the side 7Xb on the other end which correspond to the two parallel sides 7Wf and 7Wb, respectively, of the dielectric body 711 are substantially the same.

The shape of the radiation element 712, however, is not limited to a rectangle when viewed from above.

Figure 15:
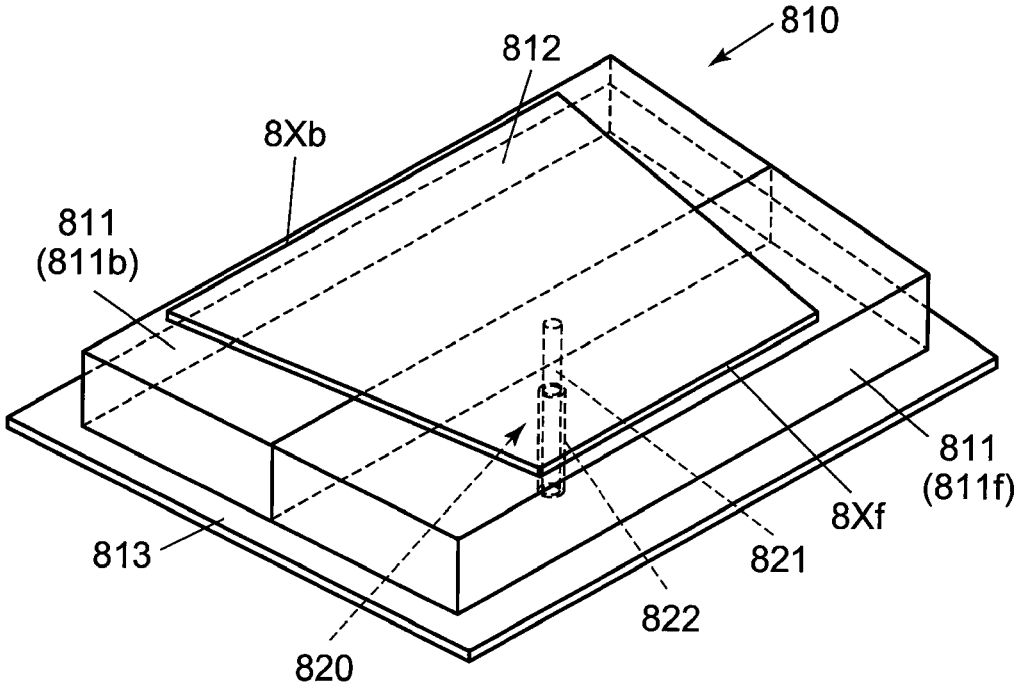
FIG. 15 is a perspective view of a patch antenna in a modification of FIGS. 14A to 14C.

For example, as shown in FIG. 15, a radiation element 812 may have the shape of an isosceles trapezoid when viewed from above, with the length L2 of the side 8Xb being a little longer than the length L1 of the side 8Xf (i.e., $L2=L1+\Delta L1$ holds in FIG. 15).

The radiation element 712 (or 812) is made of beaten silver, a metal plate or a metal film having a predetermined thickness, for example.

The radiation element 712 is formed on the surface (i.e., top surface or radiation plane) of the dielectric body 711 so as to have a uniform thickness.

The radiation element 712 is disposed substantially in the center of the dielectric body 711 in the width direction (i.e., horizontal direction in FIG. 14A). Further, at least the two parallel sides 7Xf and 7Xb are opposed to the two parallel sides 7Wf and 7Wb, respectively, on a one-to-one basis so that the opposed sides in each pair are parallel to each other.

When the radiation element 812 has the shape of an isosceles trapezoid as shown in FIG. 15, the radiation element 812 may be formed on the surface (i.e., top surface or radiation plane) of the dielectric body 811 so that all of the four sides of the radiation element 812 are opposed to the respective four sides of the dielectric body 811, and so that the opposed sides in each pair are parallel to each other.

The length of each side of the radiation element 712 is adjusted on the basis of the frequency of the radio wave to be received by the patch antenna 710 and the effective permittivity $\in$ of the dielectric body 711.

If the dielectric body 711 were not provided, the length of a side or diameter of the radiation element 712 needs to be ½ of the wavelength $\lambda$ of the radio wave to be received.

When the radio wave passes through the dielectric body 711, however, its wavelength $\lambda$ is shortened by $1/\sqrt{\in}$.

Thus, the wavelength $\lambda$ is made shorter as the dielectric body 711 has a higher effective permittivity $\in$. Accordingly, when the radiation element 712 is disposed on the surface of the dielectric body 711, the length of a side of the radiation element 712 can be longer at a part of the dielectric body 711 with a smaller effective permittivity $\in$ and can be shorter at a part of the dielectric body 711 with a larger effective permittivity $\in$.

The antenna gain of the patch antenna 710 is enhanced more as the radiation element 712 occupies a larger area of the radiation plane.

Therefore, in terms of an antenna gain, the space of the radiation plane except for the radiation element 712 (i.e., the space where the radiation element 712 is not formed) is preferably as small as possible in the case of the dielectric body 711 having the shape of an isosceles trapezoid when viewed from above.

As described above, the length of a side of the radiation element 712 corresponds to ½ of the wavelength $\lambda$ with the wavelength shortening effect according to the effective permittivity $\in$ of the dielectric body 711 taken into consideration.

That is, in the patch antenna 710 having circular polarized wave characteristics, the wavelength $\lambda$ for the frequency to be received is expressed by $\lambda/2 \approx L1/(1/\sqrt{(\in 1)}) \approx L2/(1/\sqrt{(\in 2)})$, where L1 and L2 are the lengths of the sides 7Xf and 7Xb, respectively, of the radiation element 712; and $\in 1$ and $\in 2$ are the effective permittivities of the dielectric body 711 at the sides 7Xf and 7Xb, respectively, of the radiation element 712. The effective permittivities $\in 1$ and $\in 2$ are defined by the volume of dielectric body 711 around the electric field.

In the present embodiment as show in FIGS. 14A-14C, the dielectric body 711 includes a plurality of dielectric body units 711*f* and 711*b* which have relative permittivities different from each other. Specifically, the dielectric body unit 711*b* forming the larger cross section part has a relative permittivity smaller than that of the dielectric body unit 711*f* forming the smaller cross section part.

Accordingly, when the effective permittivity $\in 2$ of the dielectric body unit 711*b* is adjusted to be substantially the same as the effective permittivity $\in 1$ of the dielectric body unit 711*f*, namely, when $\in 1 \approx \in 2$ holds where the length W1 of the side 7Wf and the length W2 of the other side 7Wb of the dielectric body 711 satisfy the relationship of W1<W2, the relationship of $L1=\lambda/2\times(1/\sqrt{(\in 1)}) \approx L2=\lambda/2\times(1/\sqrt{(\in 2)})$ holds. That is, the shape of the radiation element 712 may be a rectangle when viewed from above, with the two parallel sides 7Xf and 7Xb of the dielectric body 711 having substantially the same length.

Further, when the effective permittivity $\in 2$ of the dielectric body unit 711*b* is adjusted to be smaller than the effective permittivity $\in 1$ of the dielectric body unit 711*f*, namely, when $\in 1 > \in 2$ holds where the length W1 of the side 7Wf and the length W2 of the other side 7Wb satisfy the relationship of W1<W2, the relationship of $L1=\lambda/2\times(1/\sqrt{(\in 1)}) < L2=\lambda/2\times(1/\sqrt{(\in 2)})$ holds. Accordingly, as shown in FIG. 15, the shape of the radiation element 812 may be a trapezoid when viewed from above, with the length L2 of the side 8Xb larger than the length L1 of the side 8Xf, which results in minimizing the area of blank space on the radiation plane.

Figure 17A:
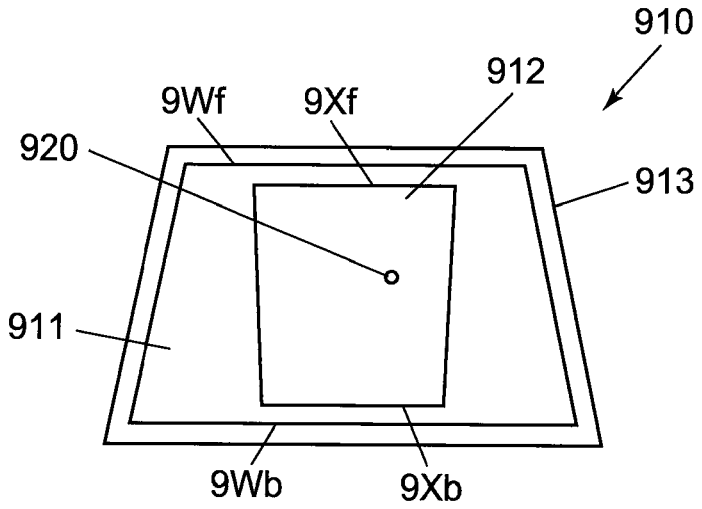
FIG. 17A is a plan view of a patch antenna in a comparative example.
Figure 17B:
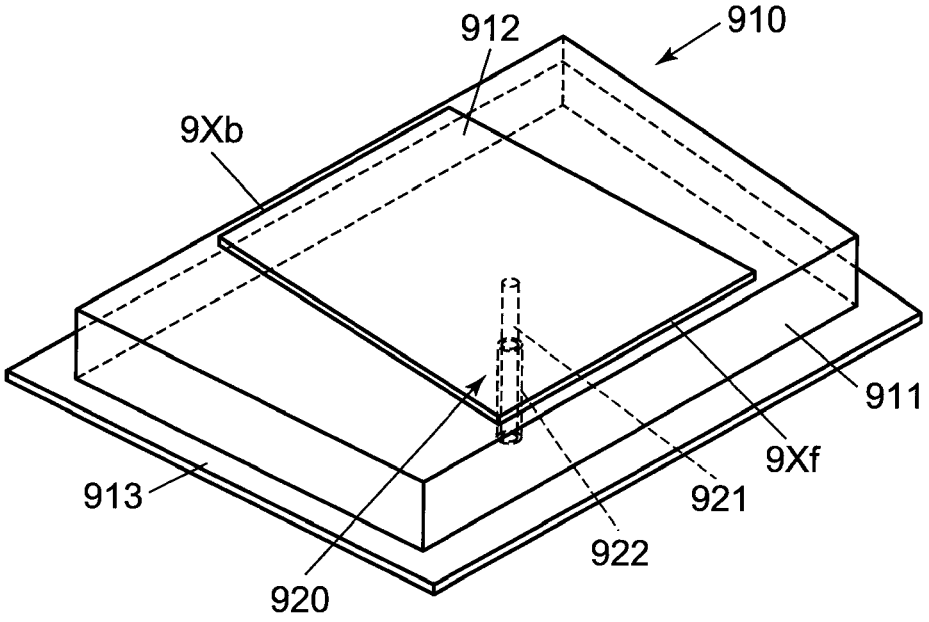
FIG. 17B is a perspective view of the patch antenna shown in FIG. 17A.

In contrast, FIGS. 17A and 17B illustrate a comparative example. In this comparative example, a dielectric body 911 has the shape of a trapezoid when viewed from above, with the length W1 of one of the two parallel sides (i.e., the side 9Wf in FIG. 17A) being smaller than the length W2 of the other of the two parallel sides (i.e., the side 9Wb in FIG. 17A). Further, in the comparative example, the entire dielectric body 911 is constituted of a single medium having a single relative permittivity.

Since the effective permittivity $\in$ is larger as the volume of the dielectric body around the electric field is larger, the effective permittivity $\in$ at the longer side 9Wb is larger than that at the shorter side 9Wf in this dielectric body.

For this reason, the length L2 of the side 9Xb of the radiation element 912 disposed near the longer side 9Wb of the dielectric body 911 (i.e., disposed on the larger cross section part) is shorter than the length L1 of the 9Xf of the radiation element 912 disposed near the shorter side 9Wf of the dielectric body 911 (i.e., disposed on the smaller cross section part) (L1>L2).

In this case, as shown in FIGS. 17A and 17B, the shape of the radiation element 912 is an inverted trapezoid when viewed from above relative to the shape of the dielectric body 911. Therefore, the radiation element 912 occupies only a smaller area of the radiation plane, which makes a blank area on the radiation plane larger.

The earth conductor 713 is larger in size than the dielectric body 711 when viewed from above.

The earth conductor 713 is made of beaten silver, a metal plate or a metal film having a predetermined thickness, for example. In this embodiment, the earth conductor 713 is made of a metal plate.

The earth conductor 713 does not necessarily need to be larger in size than the dielectric body 711 when viewed from above. Alternatively, the earth conductor 713 may be provided only on the bottom surface of the dielectric body 711. In this case, the earth conductor 713 is provided on the whole of the bottom surface of the dielectric body 711 except for the place where a coaxial cable 720 is disposed.

Another earth conductor may be further provided under the earth conductor 713, and the earth conductor 713 may be grounded through the other earth conductor.

The coaxial cable 720 as a feed member is disposed so as to penetrate through the earth conductor 713 and the dielectric body 711.

The core (inner conductor) 721 of the coaxial cable 720 is electrically connected to the radiation element 712 with solder (not shown).

The position (feed position) where the core 721 is connected to the radiation element 712 is the position having circular polarized wave characteristics, namely, the position which achieves impedance matching.

The feed position is not limited to the example shown in the drawing.

The outer conductor 722 of the coaxial cable 720 is electrically connected to the earth conductor 713 with solder (not shown).

While a one-point feeding method is employed in the present embodiment, a two-point feeding method may be employed, instead.

Further, the radiation element 712 may be fed with a feed pin as a feed member, instead of the coaxial cable 720.

The patch antenna 710 having the above-described structure is contained in the containing portion 705 along the shape of the containing portion 705 which is provided from the band attaching portion 701*a* to a part of the main body case 701.

The portion, above the patch antenna 710, of the band attaching portion 701*a* and the part of the main body case 701 is preferably covered with radio-wave permeable resin to protect the patch antenna 710.

According to the patch antenna 710 in the present embodiment, the radiation element 712 is fed at the position of the radiation element 712 having circular polarized wave characteristics, and thus can be used for an antenna for receiving a circular polarized wave such as a radio wave from GPS satellites. The wristwatch 700 including the patch antenna 710 is equipped with the function of GPS.

Further, the patch antenna 710 allows the radiation element 712 to occupy a larger area of the radiation plane than the patch antenna in the comparative example, which results in excellent antenna gain characteristics.

Next, the results of performance evaluations of the patch antenna 710 in the present embodiment and the patch antenna 910 in the comparative example as GPS receiving antennas are shown with reference to FIGS. 16A, 16B, 18A and 18B. The performance evaluations were made by field simulations in order to ascertain the enhancement of antenna gain characteristics of the patch antenna 710.

The following is the results of the simulations where directional characteristics (radiation pattern) are obtained when a frequency is 1.575 GHz.

Figure 16A:
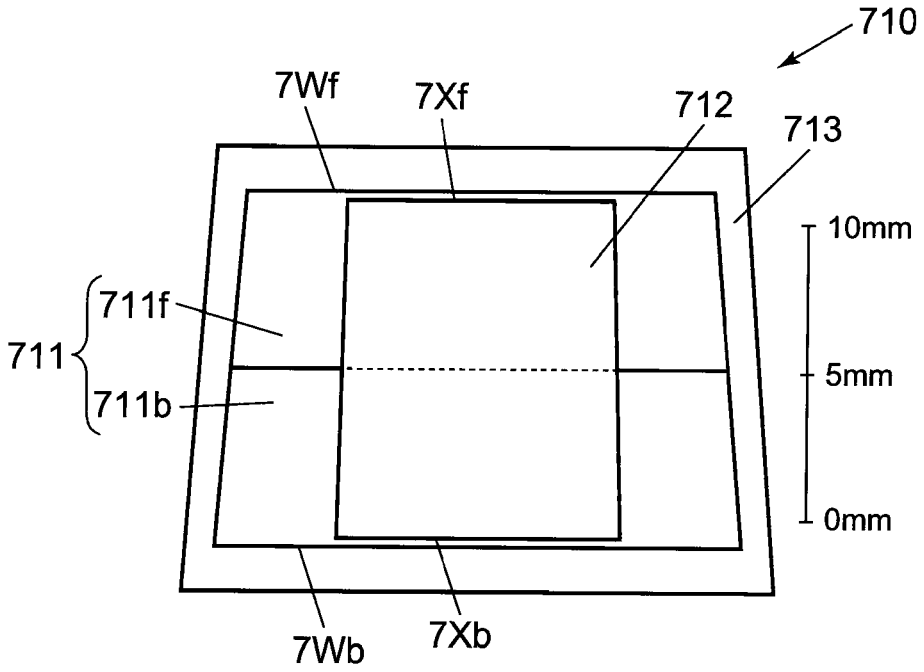
FIG. 16A is a plan view showing a simulation model of the patch antenna in the second embodiment.
Figure 18A:
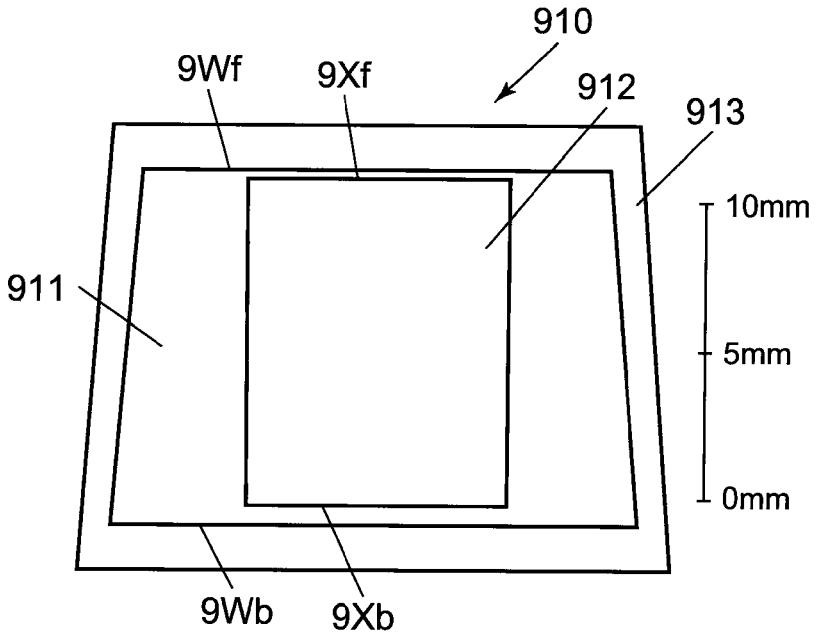
FIG. 18A is a plan view showing a simulation model of the patch antenna in the comparative example.

FIG. 16A is a plan view of the patch antenna 710 in the present embodiment used in the simulation; and FIG. 18A is a plan view of the patch antenna 910 in the comparative example used in the simulation.

In FIGS. 16A and 18A, the patch antennas are each shown with a scale as a reference.

As shown in FIG. 16A, the patch antenna 710 includes the dielectric body 711 having the shape of a trapezoid with the lengths of the sides 7Wf and 7Wb satisfying 7Wf<7Wb.

The smaller cross section part of the dielectric body 711 including the short side 7Wf is constituted of the dielectric body unit 711*f* with a relative permittivity ∈1 of 80; and the larger cross section part of the dielectric body 711 including the long side 7Wb is constituted of the dielectric body unit 711*b* with a relative permittivity ∈2 of 76.

Accordingly, the effective permittivities ∈1 and ∈2 in the dielectric body 711 are substantially the same. The radiation element 712 disposed on the surface of the dielectric body 711 has the shape of a rectangle where the length L2 of the side 7Xb positioned near the side 7Wb of the dielectric body 711 is the same as the length L1 of the side 7Xf positioned near the side 7Wf of the dielectric body 711.

In contrast, as shown in FIG. 18A, the patch antenna 910 in the comparative example used in the simulation includes the dielectric body 911 which has the shape of a trapezoid with the lengths of the sides 9Wf and 9Wb satisfying 9Wf<9Wb and which is constituted of a single medium having a relative permittivity ∈ of 80.

The larger cross section part of the dielectric body 911 including the side 9Wb has an effective permittivity ∈2 larger than the effective permittivity ∈1 of the smaller cross section part of the dielectric body 911 including the side 9Wf.

The radiation element 912 disposed on the surface of the dielectric body 911 has the shape of a rectangle where the side 9Xf positioned near the side 9Wf of the dielectric body 911 has the same length as the side 9Xb positioned near the side 9Wb of the dielectric body 911.

Figure 16B:
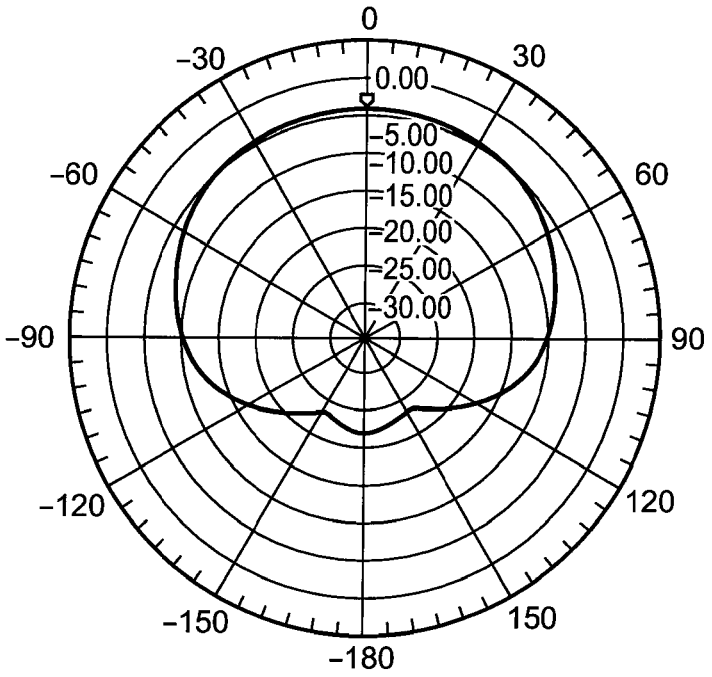
FIG. 16B illustrates the radiation pattern of the patch antenna shown in FIG. 16A.

FIG. 16B shows simulation results regarding antenna gain (dBic) for a circular polarized wave (i.e., a right handed polarized wave here) of the patch antenna 710 in the present embodiment shown in FIG. 16A.

Figure 18B:
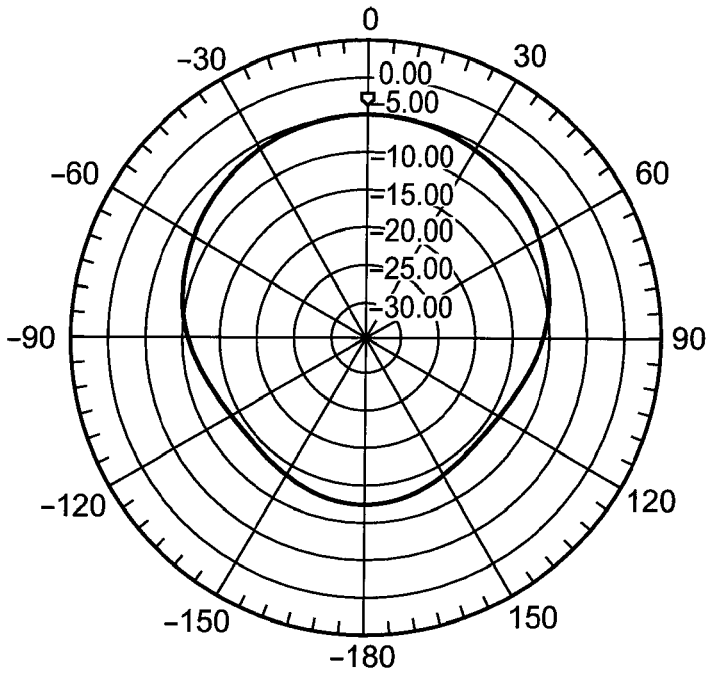
FIG. 18B illustrates the radiation pattern of the patch antenna shown in FIG. 18A.

FIG. 18B shows simulation results regarding antenna gain (dBic) for a circular polarized wave (i.e., a right handed polarized wave here) of the patch antenna 910 in the comparative example shown in FIG. 18A.

As shown in FIG. 16B, the antenna gain of the patch antenna 710 for the circular polarized wave (i.e., right handed polarized wave here) in the zenith direction (0-degree direction) was −3.8 dBic.

In contrast, as shown in FIG. 18B, the antenna gain of the conventional patch antenna 910 for the circular polarized wave (i.e., right handed polarized wave here) in the zenith direction (0-degree direction) was −4.8 dBic.

Thus, the antenna gain of the patch antenna 710 for the circular polarized wave in the zenith direction (0-degree direction) was increased by about 1.0 dB in comparison with the patch antenna 910 in the comparative example.

As can be seen from the above-described simulation results, the patch antenna 710 and the wristwatch 700 including the patch antenna 710 have the following advantageous effects.

The dielectric body 711, which increases in cross-sectional area from one of the two parallel sides thereof toward the other, includes a plurality of dielectric body units 711*f* and 711*b* which are bonded to each other and which have relative permittivities different from each other. Thus, the effective permittivity ∈ is adjusted in such a way that the larger cross section part has a relative permittivity smaller than that of the smaller cross section part. Therefore, the length of each side of the radiation element 712 can be adjusted in accordance with the planar shape (i.e., the shape of the radiation plane) of the dielectric body 711.

Thus, the radiation element 712 can occupy a larger area of the radiation plane, and the area of the radiation plane can be utilized to the maximum.

This enhances the antenna gain of the patch antenna 710.

Further, even when the shape of the dielectric body 711 is not a square prism but a trapezoid prism, for example, the area of the radiation plane can be utilized to the maximum, which achieves excellent antenna gain characteristics. Therefore, even when the band attaching portion 701*a* is provided with a containing portion 705 whose shape is not a square prism but a special shape as shown in FIGS. 13A and 13B, for example, the antenna gain of the patch antenna 710 can be enhanced maximally by adjusting the effective permittivity ∈.

The patch antenna 710, therefore, can be disposed in the band attaching portion 701*a* with no wasted space. Disposing the patch antenna 710 in the band attaching portion 701*a* is advantageous because the portion 701*a* has a relatively large space for the patch antenna 710 than the main body case 701 where various electronic units are disposed. As a result, the patch antenna 710 and the wristwatch 700 (wireless communications device) provide excellent communication performance without compromising the appearance and design of the wristwatch 700.

While the dielectric body 711 in the present embodiment is constituted of the two dielectric body units 711*f* and 711*b* having relative permittivities different from each other as show in FIGS. 14A-14C, the number of the dielectric body units constituting the dielectric body 711 is not limited to two.

Figure 19A:
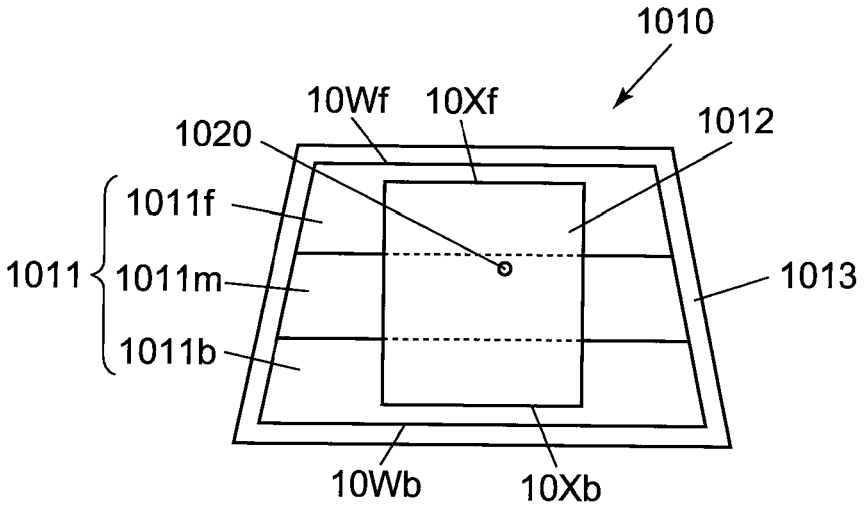
FIG. 19A is a plan view of a patch antenna in a modification of the second embodiment.
Figure 19B:
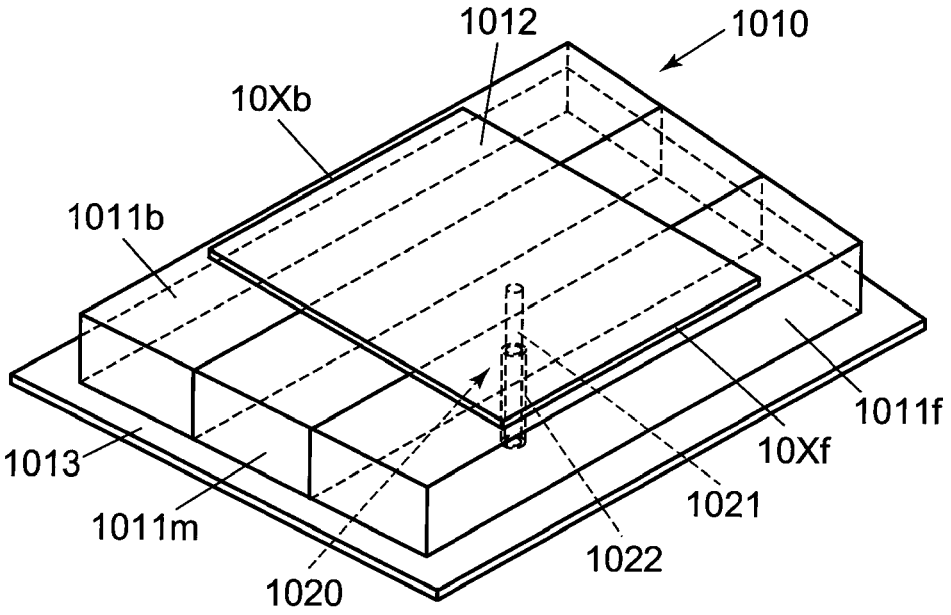
FIG. 19B is a perspective view of the patch antenna shown in FIG. 19A.

Alternatively, a dielectric body 1011 of a patch antenna 1010 may include three dielectric body units 1011*f*, 1011*m* and 1011*b* as shown in FIGS. 19A and 19B, for example. The dielectric body units 1011*f*, 1011*m* and 1011*b* form the smallest, intermediate and largest cross section parts, respectively, of the dielectric body 1011.

In this case, the relative permittivities of the dielectric body units 1011*f*, 1011*m* and 1011*b* are adjusted so that the smallest cross section area part including the side 10Wf has the largest effective permittivity ∈, and the largest cross section area part including the side 10Wb has the smallest effective permittivity ∈.

That is, the relationship of ∈1>∈2>∈3 holds where ∈1 is the effective permittivity of the dielectric body unit 1011*f* forming the smallest cross section area part including the side 10Wf, ∈3 is the effective permittivity of the dielectric body unit 1011*b* forming the largest cross section area part including the side 10Wb, and ∈2 is the effective permittivity of the dielectric body unit 1011*m* disposed between the dielectric body units 1011*f* and 1011*b*.

This allows the length L1 of the side 10Xf of the radiation element 1012 which is positioned on the smallest cross section area part and the length L2 of the side 10Xb of the radiation element 1012 which is positioned on the largest cross section area part to satisfy L1≈L2 or L1<L2. Accordingly, the radiation element 1012 can occupy a larger area of the radiation plane.

The dielectric body 1011 may include four or more dielectric body units in the same manner.

Third Embodiment

Next, a patch antenna and a wireless communications device (wristwatch) in a third embodiment of the present invention are described below with reference to FIGS. 20A-20C. The third embodiment is different from the second embodiment only in the structure of a patch antenna. Hence, the description will focus on the difference from the second embodiment, in particular.

Figure 20A:
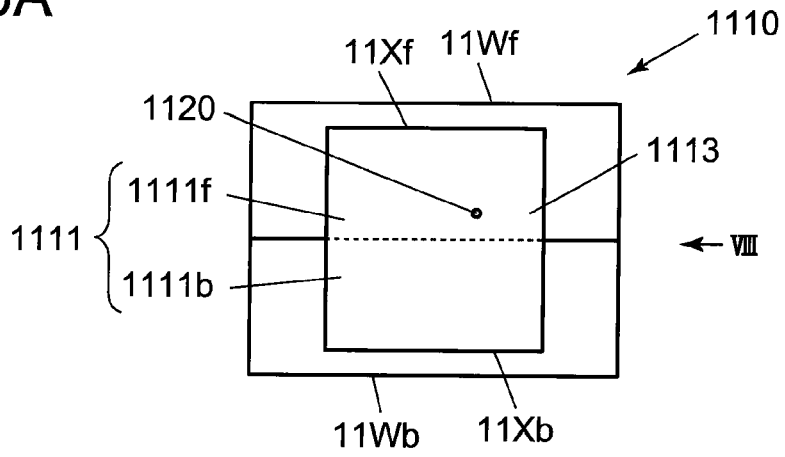
FIG. 20A is a plan view of a patch antenna in a third embodiment.
Figure 20B:
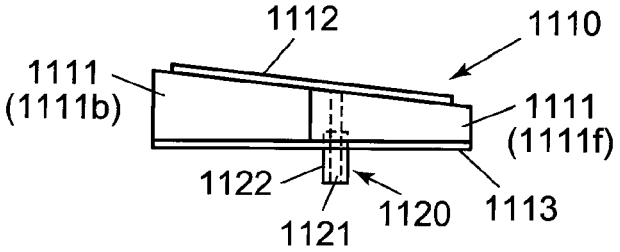
FIG. 20B is a side view of the patch antenna shown in FIG. 20A, the patch antenna being viewed from the direction of VIII.
Figure 20C:
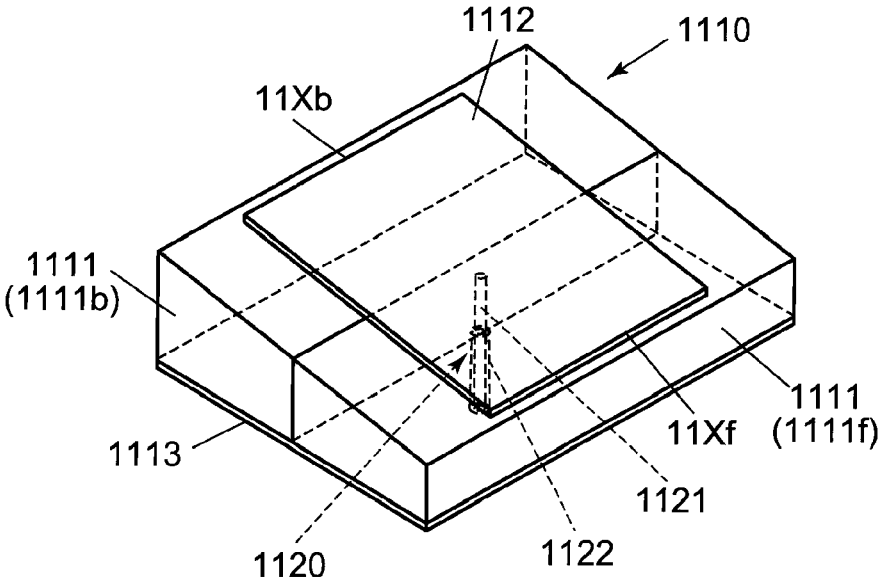
FIG. 20C is a perspective view of the patch antenna shown in FIG. 20A.

FIGS. 20A-20C are a plan view, a side view and a perspective view, respectively, of a patch antenna 1110 in the present embodiment.

As shown in FIGS. 20A-20C, the patch antenna 1110 has the shape of a rectangle when viewed from above.

The patch antenna 1110 is formed so that the height of its top surface increases in the direction from a band 702*a* toward a main body case 701 when viewed from the side, with the patch antenna 1110 mounted in the wristwatch.

That is, the top surface of the patch antenna 1110 is an inclined plane which is inclined upward in the direction from the band 702*a* toward the main body case 701, and the patch antenna 1110 has the shape of a trapezoid when viewed from the side.

In the present embodiment, a dielectric body 1111 has the shape of a trapezoid when viewed from the side. More specifically, the thickness of the dielectric body 1111 increases from the side 11Wf toward the side 11Wb as shown in FIG. 20A, the sides 11Wf and 11Wb being parallel to each other.

The effective permittivity of the dielectric body 1111 is adjusted by making the relative permittivities of the dielectric body units 1111*b* and 1111*f* different from each other. Specifically, the dielectric body unit 1111*b* forming the larger cross section part of the dielectric body 1111 has a relative permittivity smaller than that of the dielectric body unit 1111*f* forming the smaller cross section part of the dielectric body 1111.

The length of a side of a radiation element 1112 is adjusted in view of the wavelength shortening effect according to the effective permittivity of the dielectric body 1111.

In the present embodiment, an earth conductor 1113 has the same size and shape as the dielectric body 1111 when viewed from above.

The earth conductor 1113, however, may be larger in size than the dielectric body 1111 instead.

Since the other structure in the present embodiment is the same as that in the second embodiment, the same signs are assigned to the same components and repetitive explanations are omitted.

When the dielectric body 1111 has the shape of a rectangle when viewed from above and has the shape of a trapezoid when viewed from the side, and when the entire dielectric body 1111 is made of a single material; the larger cross section (volume) part of the dielectric body 1111 has a larger wavelength shortening effect according to an effective permittivity ∈ than the smaller cross section (volume) part of the dielectric body 1111 around the electric field. Accordingly, a side of the radiation element is shorter at the larger cross section part than at the smaller cross section part.

In contrast, the dielectric body 1111 in the present embodiment is not uniform in thickness and also not uniform in relative permittivity. Therefore, the length of a side of the radiation element 1112 can be adjusted in accordance with the shape of the radiation plane of the dielectric body 1111 in view of the wavelength shortening effect due to the effective permittivity ∈ of the dielectric body 1111. As a result, the radiation element 1112 can occupy a larger area of the radiation plane of the dielectric body 1111.

As described above, according to the patch antenna 1110 in the present embodiment and a wristwatch 700 including the patch antenna 1110, the following advantageous effects can be obtained in addition to the advantageous effects of the second embodiment.

In the present embodiment, even when the containing portion provided in a wireless communications device, such as the wristwatch 700, has the shape of a rectangle when viewed from above and has the shape of a trapezoid when viewed from the side, with the thickness of the containing portion increasing in the direction from the band 702*a* toward the main body case 701, the patch antenna 1110 can be designed to have the shape corresponding to the shape of the containing portion.

In this case, too, the radiation element 1112 can occupy a large area of the radiation plane of the dielectric body 1111, which enables the antenna to have an excellent antenna gain.

While the dielectric body 1111 in the present embodiment is constituted of the two dielectric body units 1111*f* and 1111*b* having relative permittivities different from each other as show in FIGS. 20A-20C, the number of the dielectric body units constituting the dielectric body 1111 is not limited to two.

Figure 21A:
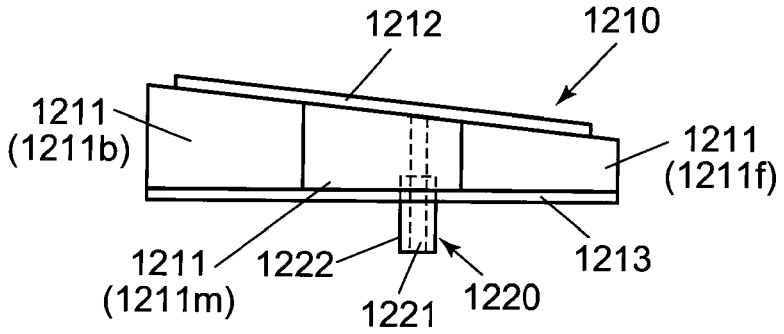
FIG. 21A is a side view of a patch antenna in a modification of the third embodiment.
Figure 21B:
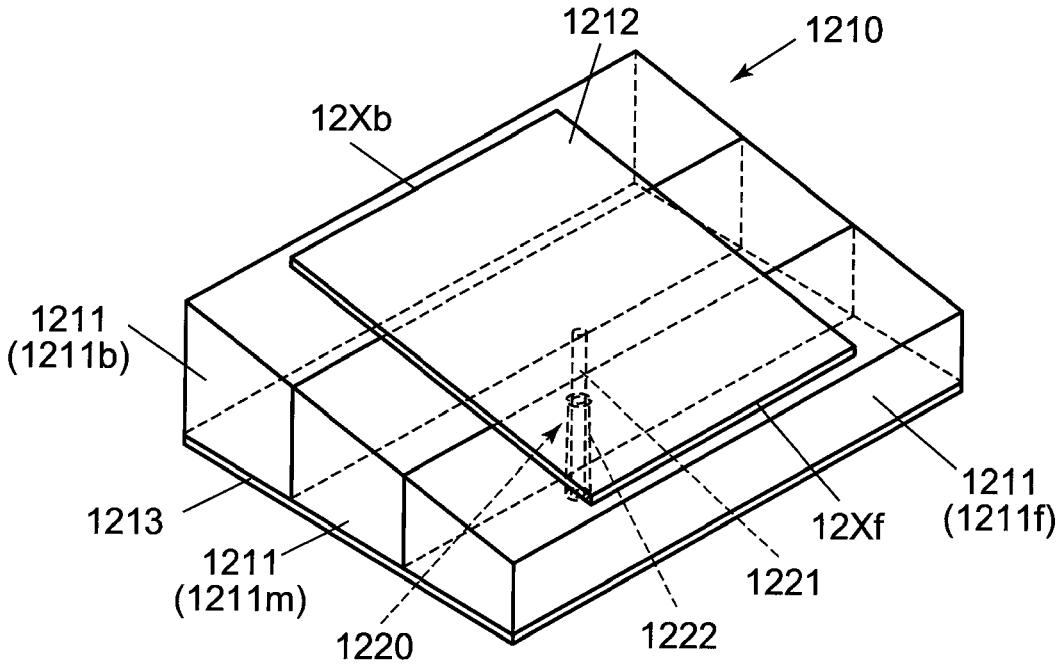
FIG. 21B is a perspective view of the patch antenna shown in FIG. 21A.

Alternatively, a dielectric body 1211 of a patch antenna 1210 may include three dielectric body units 1211*f*, 1211*m* and 1211*b*, for example, as shown in FIGS. 21A and 21B. The dielectric body units 1211*f*, 1211*m* and 1211*b* form the smallest, intermediate and largest cross section parts, respectively, of the dielectric body 1211.

In this case, the relative permittivities of the dielectric body units 1211*f*, 1211*m* and 1211*b* are adjusted so that the smallest cross section area part has the largest effective permittivity ∈, and the largest cross section area part has the smallest effective permittivity ∈.

That is, the relationship of ∈1>∈2>∈3 holds where ∈1 is the effective permittivity of the dielectric body unit 1211*f* forming the smallest cross section area part, ∈3 is the effective permittivity of the dielectric body unit 1211*b* forming the largest cross section area part, and ∈2 is the effective permittivity of the dielectric body unit 1211*m* disposed between the dielectric body units 1211*f* and 1211*b*.

This allows the length L1 of the side 12Xf of the radiation element 1212 which is positioned on the smallest cross section area part to be substantially the same as the length L2 of the side 12Xb of the radiation element 1212 which is positioned on the largest cross section area part. Accordingly, the radiation element 1212 can occupy a larger area of the radiation plane.

The dielectric body 1211 may include four or more dielectric body units in the same manner.

Further, in the present embodiment, a plurality of dielectric body units 1111*f* and 1111*b* having relative permittivities different from each other are arranged in the direction from one of the two parallel sides toward the other of the two parallel sides to constitute the dielectric body 1111. The structure of the dielectric body, however, is not limited thereto.

Figure 22A:
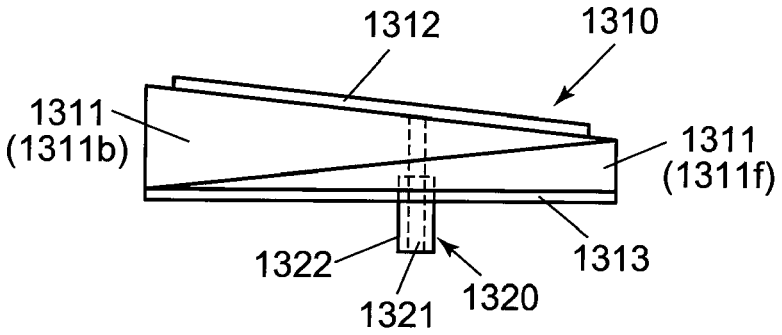
FIG. 22A is a side view of a patch antenna in another modification of the third embodiment.
Figure 22B:
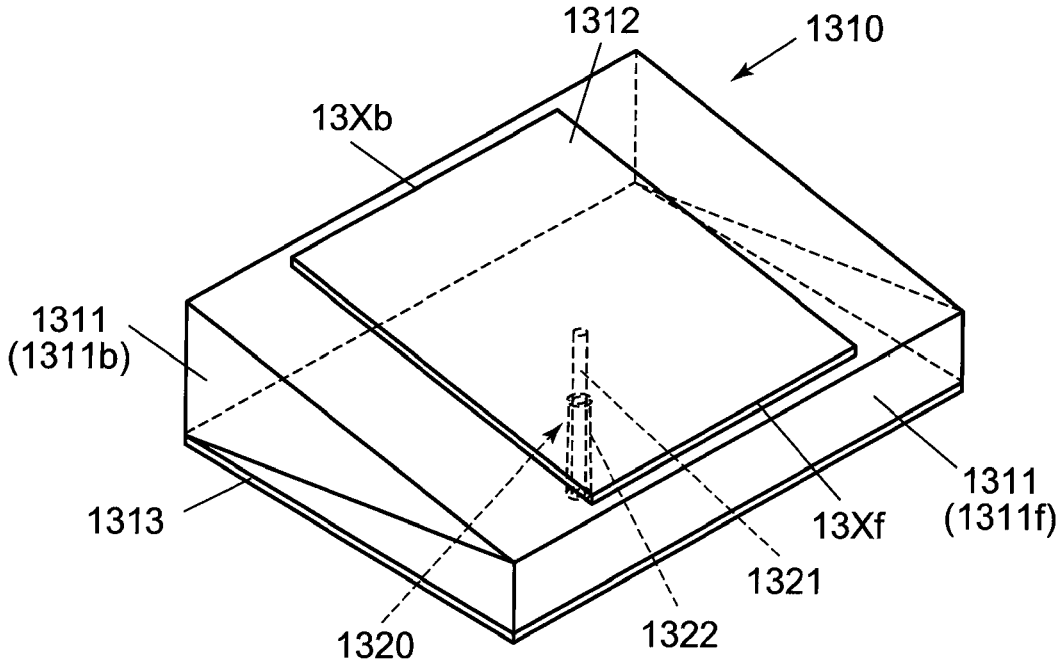
FIG. 22B is a perspective view of the patch antenna shown in FIG. 22A.

For example, as shown in FIGS. 22A and 22B, a dielectric body 1311 may include a plurality of dielectric body units 1311*f* and 1311*b* having relative permittivities different from each other, each of the dielectric body units 1311*f* and 1311*b* having the shape of a triangle or trapezoid when viewed from the side. The thickness of each of the dielectric body units 1311*f* and 1311*b* varies in the direction from one side toward the other side of the two parallel sides of the dielectric body 1311. In this case, a thicker part of one of the units 1311*f* and 1311*b* lies over a thinner part of the other of the units 1311*f* and 1311*b* to constitute the dielectric body 1311.

When the thickest part of the dielectric body unit 1311*b* forms a greater height than the thickest part of the dielectric body unit 1311*f* as shown in FIGS. 22A and 22B, the effective permittivity around the electric field of the dielectric body 1311 (i.e., around the sides 13Xf and 13Xb of the radiation element 1312) can be substantially uniform by forming the dielectric body unit 1311*b* of material with a smaller relative permittivity than the dielectric body unit 1311*f*.

This allows the side 13Xf of the radiation element 1312 positioned on the smaller cross section area part to have substantially the same length as the side 13Xb of the radiation element 1312 positioned on the larger cross section area part. Accordingly, the radiation element 1312 can occupy a larger area of the radiation plane.

The dielectric body 1311 may include three or more dielectric body units lying on top of one another in the same manner.

The present invention is not limited to the above-described embodiments but may be modified in various ways.

For example, the dielectric body in the second embodiment has the shape of a trapezoid when viewed from above. More specifically, the dielectric body in the second embodiment has two sides 7Wf and 7Wb parallel to each other; and the dielectric body 711 increases in width from one side 7Wf toward the other side 7Wb, as shown in FIG. 14A. The width of the dielectric body 711 means the dimension of the dielectric body 711 in the direction parallel to the sides 7Wf and 7Wb. The dielectric body in the third embodiment has the shape of a rectangle when viewed from above and has a trapezoid when viewed from the side. Specifically, the thickness of the dielectric body in the third embodiment increases from the side 11Wf toward the side 11Wb as shown in FIG. 20A, the sides 11Wf and 11Wb being parallel to each other. The shape of the dielectric body, however, is not limited to those of the second and third embodiments.

Figure 23A:
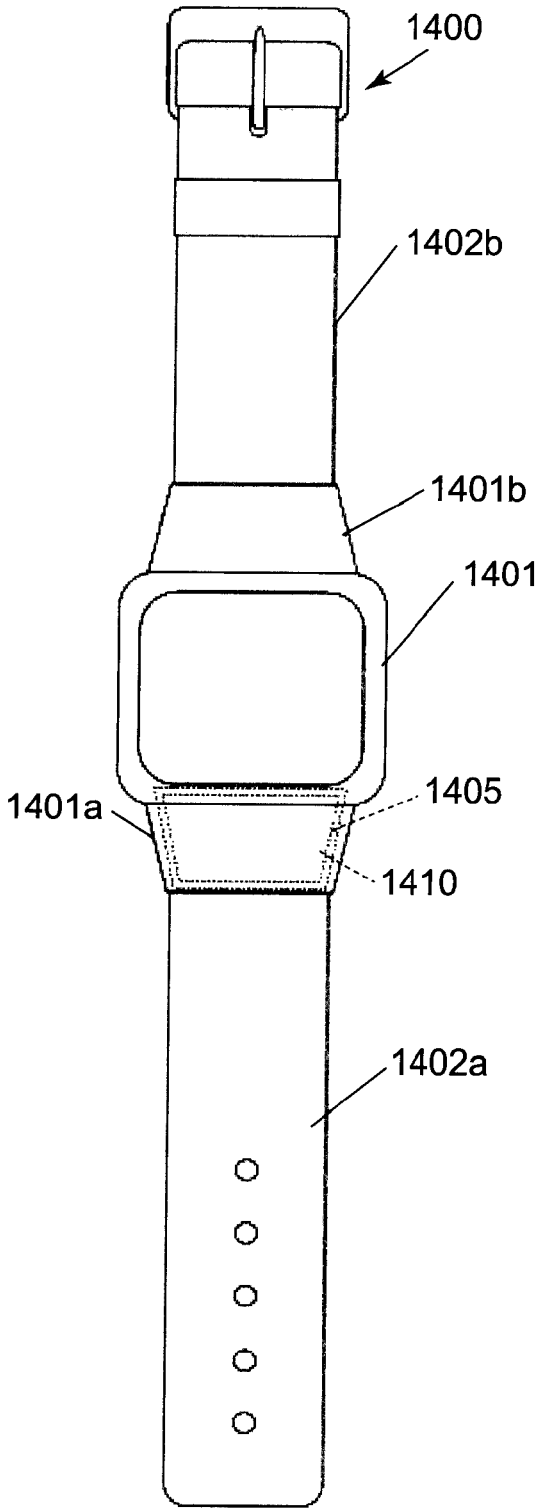
FIG. 23A is a plan view of a wristwatch in a modification.
Figure 23B:
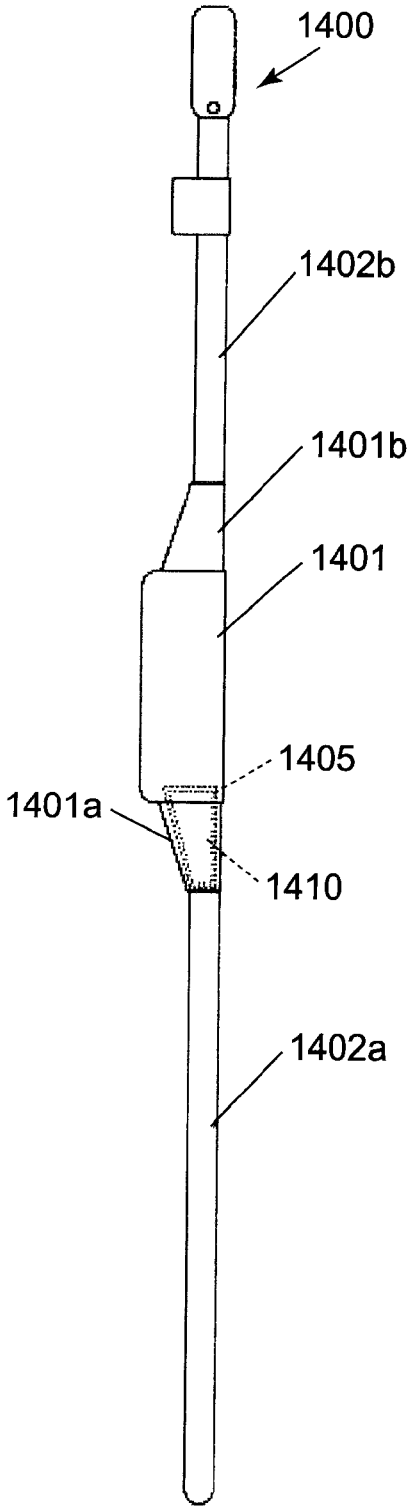
FIG. 23B is a side view of the wristwatch in the modification.

For example, a wristwatch 1400 (wireless communications device) shown in FIGS. 23A and 23B has band attaching portions 1401*a* and 1401*b* each having the shape of an isosceles trapezoid when viewed from above, with the widths of the portions 1401*a* and 1401*b* decreasing in the direction from a main body case 1401 toward bands 1402*a* and 1402*b*, respectively, and each having the shape of a trapezoid when viewed from the side, with the heights of the top surfaces of the portions 1401*a* and 1401*b* increasing in the direction from the bands 1402*a* and 1402*b*, respectively, toward the main body case 1401.

In this case, a containing portion 1405 may be provided. The containing portion 1405 has the shape of an isosceles trapezoid when viewed from above, with the width thereof increasing in the direction from the band 1402*a* toward the main body case 1401 along the edges of the band attaching portion 1401*a* and the main body case 1401; and has the shape of a trapezoid when viewed from the side, with the height thereof increasing in the direction from the band 1402*a* toward the main body case 1401.

In this case, a patch antenna 1410 contained within the containing portion 1405 may also have the shape of an isosceles trapezoid when viewed from above and have the shape of a trapezoid when viewed from the side, with the height thereof increasing in the direction from the band 1402*a* toward the main body case 1401 in accordance with the shape of the containing portion 1405.

A dielectric body 1411 disposed on an earth conductor 1413 is constituted of two dielectric body units 1411*f* and 1411*b* having relative permittivities different from each other. Specifically, the dielectric body unit 1411*b* forming the larger cross section part of the dielectric body 1411 has a relative permittivity smaller than that of the dielectric body unit 1411*f* forming the smaller cross section part of the dielectric body 1411. Thus, the effective permittivity of the dielectric body 1411 can be adjusted.

Figure 24A:
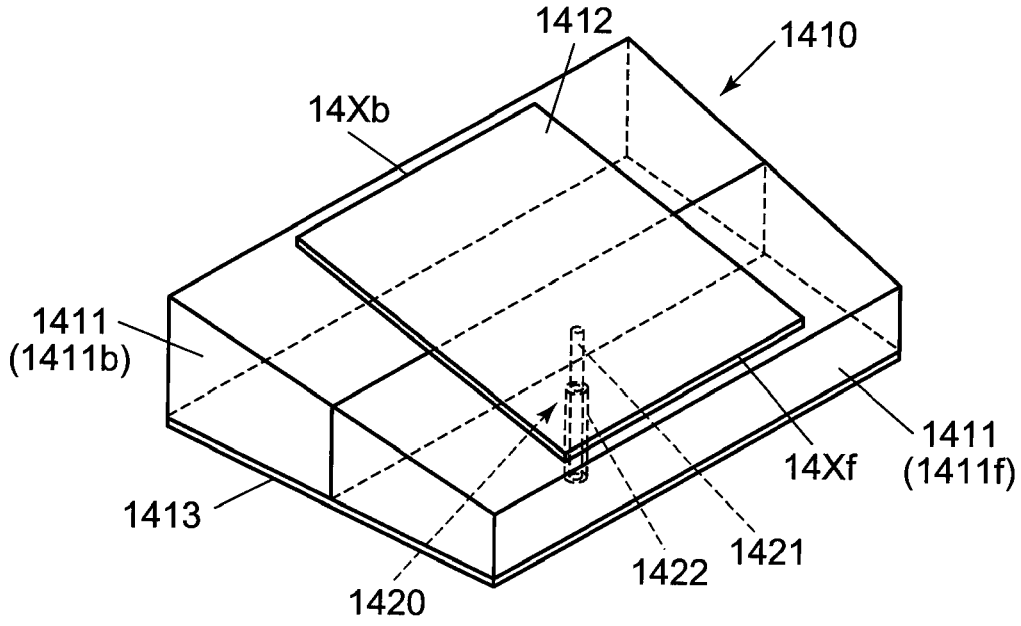
FIG. 24A is a perspective view of an example of a patch antenna to be mounted in the wristwatch shown in FIGS. 23A and 23B.

This allows the length L1 of the side 14Xf of the radiation element 1412 which is positioned on the smaller cross section part to be substantially the same as the length L2 of the side 14Xb of the radiation element 1412 which is positioned on the larger cross section part, as shown in FIG. 24A. Accordingly, the radiation element 1412 can occupy a larger area of the radiation plane.

Figure 24B:
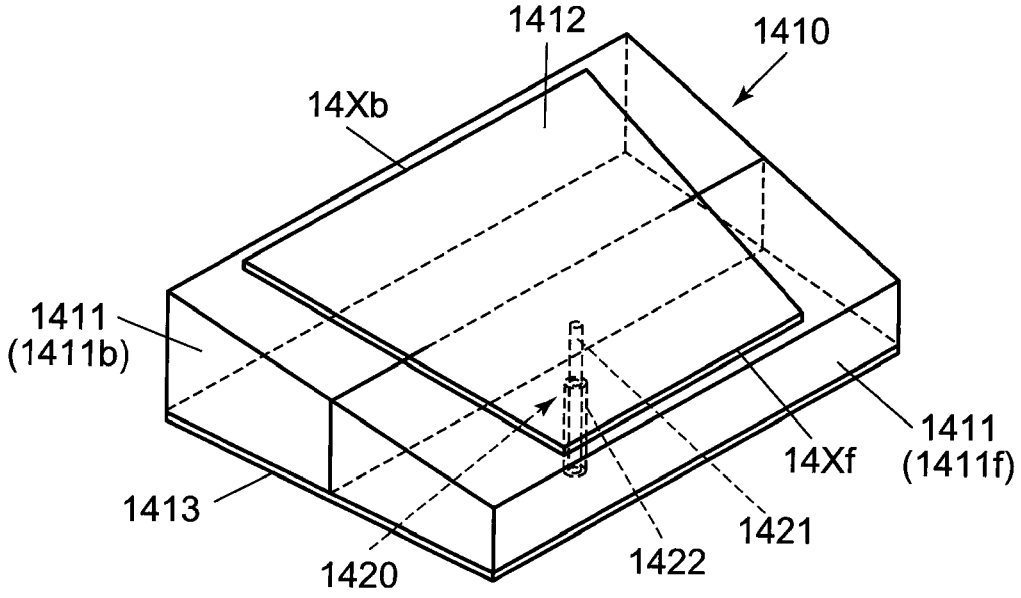
FIG. 24B is a perspective view of another example of a patch antenna to be mounted in the wristwatch shown in FIGS. 23A and 23B.

Further, by adjusting the effective permittivities of the dielectric body units so that the one unit forming the larger cross section part has a smaller effective permittivity than the other unit forming the smaller cross section part, the lengths L1 and L2 can satisfy the relation of L1<L2, as shown in FIG. 24B. This allows the radiation element 1412 to occupy a still larger area of the radiation plane.

In this case, the dielectric body 1411 may include three or more dielectric body units. Further, the dielectric body 1411 may also be constituted of a plurality of dielectric body units lying on top of each other.

Further, while the patch antennas in the above-described embodiments each include a radiation element having the shape of a rectangle or trapezoid, each patch antenna may include a radiation element with a pair of diagonally-opposed corners thereof cut off.

When the radiation element has such a shape, a patch antenna can also serve as an antenna for receiving a circular polarized wave.

Further, while the patch antennas in the above-described embodiments employ a one-point feeding method, the present invention is also applicable to a patch antenna employing a two-point feeding method.

Further, while a patch antenna is mounted in a wristwatch as a wireless communications device in each of the above-described embodiments, the wireless communications device may be a digital camera, a smartphone, a personal navigation device (PND), for example.

The scope of the present invention is not limited to the above-described embodiments and modifications, but covers the scope of the claims and its equivalents.

The entire disclosure of Japanese Patent Applications No. 2012-206864 filed on Sep. 20, 2012 and No. 2012-206784 filed on Sep. 20, 2012 including description, claims, drawings, and abstract are incorporated herein by reference in its entirety.

Although various exemplary embodiments have been shown and described, the invention is not limited to the embodiments shown. Therefore, the scope of the invention is intended to be limited solely by the scope of the claims that follow.

What is claimed is:

1. A patch antenna comprising:

a dielectric body which increases in cross-sectional area from a first end toward a second end thereof;

a radiation element which is disposed on a surface of the dielectric body and each side of which has a length adjusted based on a frequency of a radio wave to be received and an effective permittivity of the dielectric body;

an earth conductor disposed on a bottom surface of the dielectric body; and a feed member electrically connected to the radiation element, wherein the dielectric body has an inclined plane which is inclined so that the dielectric body increases in height along a to surface thereof from the first end toward the second end thereof, and wherein the dielectric body decreases in width from the first end toward the second end thereof so as to have a shape of a trapezoid when viewed from above.

2. The patch antenna according to claim 1, wherein:

the dielectric body has a width which increases as a thickness of the dielectric body decreases, and the dielectric body has a shape of an isosceles trapezoid when viewed from above.

3. A wireless communications device comprising a patch antenna and a containing portion which contains the patch antenna, the patch antenna comprising:

a dielectric body which increases in cross-sectional area from a first end toward a second end thereof;

a radiation element which is disposed on a surface of the dielectric body and each side of which has a length adjusted based on a frequency of a radio wave to be received and an effective permittivity of the dielectric body;

an earth conductor disposed on a bottom surface of the dielectric body; and a feed member electrically connected to the radiation element, wherein the dielectric body has an inclined plane which is inclined so that the dielectric body increases in height along a to surface thereof from the first end toward the second end thereof, wherein the dielectric body decreases in width from the first end toward the second end thereof so as to have a shape of a trapezoid when viewed from above, and wherein the containing portion has a shape corresponding to a shape of the patch antenna when viewed from above and/or when viewed from a side.

4. The wireless communications device according to claim 3, further comprising:

a main body case; and a band attaching portion to attach a band to the main body case, wherein the containing portion is disposed in the band attaching portion or disposed in the band attaching portion and a part of the main body case, the part being adjacent to the band attaching portion.

* * * * *

UNITED STATES PATENT AND TRADEMARK OFFICE

CERTIFICATE OF CORRECTION

PATENT NO. : 9,231,306 B2
APPLICATION NO. : 13/953445
DATED : January 5, 2016
INVENTOR(S) : Kazuaki Abe It is certified that error appears in the above-identified patent and that said Letters Patent is hereby corrected as shown below:

IN THE CLAIMS

Column 22, line 3, delete “to” and insert --top--.

Column 22, line 28, delete “to” and insert --top--.

Signed and Sealed this
Nineteenth Day of April, 2016

Michelle K. Lee

Michelle K. Lee
*Director of the United States Patent and Trademark Office*